US009237393B2

(12) United States Patent
Abrahamsson et al.

(10) Patent No.: US 9,237,393 B2
(45) Date of Patent: Jan. 12, 2016

(54) HEADSET WITH ACCELEROMETERS TO DETERMINE DIRECTION AND MOVEMENTS OF USER HEAD AND METHOD

(75) Inventors: Magnus Abrahamsson, Loddekopinge (SE); David Johansson, Klagshamm (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 577 days.

(21) Appl. No.: 12/953,951

(22) Filed: Nov. 24, 2010

(65) Prior Publication Data

US 2012/0114132 A1 May 10, 2012

Related U.S. Application Data

(60) Provisional application No. 61/410,607, filed on Nov. 5, 2010.

(51) Int. Cl.

| | |
|---|---|
| ***H04R 5/02*** | (2006.01) |
| ***H04R 1/10*** | (2006.01) |
| ***H04S 7/00*** | (2006.01) |

(52) U.S. Cl.

CPC ..... *H04R 1/1016* (2013.01); *H04R 1/1041* (2013.01); *H04S 7/304* (2013.01); *H04R 2460/07* (2013.01)

(58) Field of Classification Search

CPC ..... H04S 7/304; G06F 3/012; G06F 3/0346; G06F 3/04815

USPC ..... 381/310

See application file for complete search history.

(56) References Cited

U.S. PATENT DOCUMENTS

| | | | | |
|---|---|---|---|---|
| 7,116,789 | B2 * | 10/2006 | Layton et al. | 381/17 |
| 7,756,274 | B2 | 7/2010 | Layton et al. | |
| 2005/0177929 | A1 * | 8/2005 | Greenwald et al. | 2/425 |
| 2010/0150355 | A1 * | 6/2010 | Kon et al. | 381/17 |
| 2010/0161271 | A1 | 6/2010 | Shah et al. | |
| 2012/0002822 | A1 * | 1/2012 | Peissig et al. | 381/74 |

FOREIGN PATENT DOCUMENTS

| | | | |
|---|---|---|---|
| DE | 10 2008 055180 | A1 | 7/2010 |
| WO | 98/55833 | A1 | 12/1998 |
| WO | 2009/144529 | A1 | 12/2009 |

OTHER PUBLICATIONS

"Accelerometer." Wikipedia. Published Oct. 28, 2009. Accessed Mar. 7, 2013 at Internet Archive: Wayback Machine.*

European Search Report, corresponding to EP 11184035.1, dated Jul. 31, 2012.

* cited by examiner

*Primary Examiner* — Duc Nguyen
*Assistant Examiner* — Kile Blair
(74) *Attorney, Agent, or Firm* — Renner, Otto, Boisselle & Sklar, LLP.

(57) ABSTRACT

An audio headset system for a mobile phone or other audio player includes a pair of earpieces, each including a speaker in a housing and configured to provide audio output, the housing configured for positioning with respect to a user's ear to direct audio output to the ear; and a pair of accelerometers configured to provide acceleration information representative of acceleration of the respective earpieces, wherein together the acceleration information provided from both accelerometers is representative of angular motion in a horizontal plane of the head of a user. The angular motion may be used as inputs to carry out functions of the mobile phone, e.g., to provide sound adjustments for three dimensional stereophonic sound, to provide navigation information to a user, to play games, and so on. A method of determining rotation and/or direction of a user's head wearing a headset including an ear piece with an accelerometer at each ear, includes processing acceleration information from both accelerometers to determine angular motion of the user's head in a generally horizontal plane.

19 Claims, 10 Drawing Sheets

HEADSET WITH ACCELEROMETERS TO DETERMINE DIRECTION AND MOVEMENTS OF USER HEAD AND METHOD

CROSS-REFERENCE TO RELATED APPLICATION

This application claims the benefit of U.S. Provisional Patent Application Ser. No. 61/410,607, filed Nov. 5, 2010, the entire disclosure of which is hereby incorporated by reference.

TECHNICAL FIELD

The present invention relates generally, as indicated, to a headset with accelerometers to determine direction and movements of a user's head and method, and, more particularly, to a headset and method used in small listening devices, such as, for example, ear buds or the like.

BACKGROUND

Mobile and/or wireless electronic devices are becoming increasingly popular. For example, mobile telephones, portable media players and portable gaming devices are now in wide-spread use. In addition, the features and accessories associated with certain types of electronic devices have become increasingly diverse. To name a few examples, many electronic devices have cameras, text messaging capability, Internet browsing capability, electronic mail capability, video playback capability, audio playback capability, image display capability and handsfree headset interfaces. Exemplary accessories may also include headsets to provide sounds, e.g., music or other audio content, music and video input players, etc.

Headphones, also sometimes referred to as earphones, are a type of headset (also referred to as listening device) that have been used to listen to audio content or material, e.g., sounds, such as music, lectures and so on, provided from various electronic devices, such as, for example, stationary music players, radios and the like, and portable electronic devices, such as, for example, mobile phones, Sony Walkman players, and so on. Headphones typically have used speakers that are positioned over the ears of a user to convey audio content to the respective ears and a support bar on which the speakers are mounted; the support bar fits over the user's head to hold the speakers in generally fixed relation to each other and in place over the user's ears, as is well known. The modern trend has been to reduce the size of such portable electronic devices and also to reduce the size of listening devices used to listen to audio content provided from such portable electronic devices. An example of a modern small listening device is the ear bud; for example, two ear buds (sometimes referred to as ear bud listening devices), each placed in a respective ear of a user, may be used to convey audio content directly to the user's ears. Ear buds do not require a physical mechanical connection between them, such as the physical connection and mechanical support that typically is provided by a support bar used for conventional headphones.

In many cases it is desirable to know information representing or indicating the direction and/or rotation of the head of a user of a portable electronic device, such as, for example, a mobile phone, music or other sound playing device, personal digital assistant, game device and so on. This information may be useful for gaming, virtual reality, augmented reality, and so on, as audio content and navigation information is heard by a user. Some modern mobile phones have direction sensors, but the mobile phone will not provide information pertaining to a user's head facing direction or rotation information, since usually it does not track movements of the user's head. Some virtual reality display systems that provide both image and audio outputs have used headsets that include head tracking mechanisms to alter images and/or sounds in relation to the direction of the user's head. One example of a sensor to use for tracking rotation of the head is a gyroscope. However, although a gyroscope may be useful mounted on a conventional headset, it is problematic for use in ear buds because gyroscopes are large, expensive and consume a substantial amount of power, e.g., as compared to the relatively small size of ear buds and their relatively low cost small power requirements. A magnetometer provides absolute direction compared to a geomagnetic field, but the strong magnetic field produced by the speaker in an ear bud would saturate the magnetometer.

It has been a problem to obtain angular motion information of the head of a user while using small ear pieces, e.g., earbuds, that are not mounted relative to each other on a fixed support like conventional earphones. Quite small earpieces, e.g., earbuds, may simply be attached to and relatively loosely dangle at the end of an electrical cable. Although such earbuds are convenient for listening to sounds from a portable electronic equipment and easily can be stored, they have not previously been able to obtain features of heavier earphone systems with rigid connection bars between speakers and gyroscopic type direction monitoring/obtaining devices that can use the direction information for various purposes, e.g., to obtain three-dimensional stereophonic audio output, changing of audio output in response to changes in direction, and so on.

SUMMARY

An accelerometer associated with each earpiece of a headset, such as, for example, ear buds or other small audio listening devices, provides information to determine the rotation and direction of the user's head.

A method of using information from accelerometers associated with each earpiece of a headset, such as, for example, ear buds or other small audio listening devices, determines the rotation and direction of a user's head.

Directional information and reference information, such as, for example, downward direction, is coordinated to track direction and rotation of the head of a user wearing small audio listening devices.

An aspect relates to an audio headset system, including a pair of earpieces, each earpiece including a speaker configured to provide audio output, and a housing, the speaker mounted with respect to the housing, the housing configured for positioning with respect to an ear of a user to direct audio output from the speaker to the ear; and a pair of accelerometers configured to provide acceleration information representative of acceleration of the respective earpieces, wherein together the acceleration information provided from both accelerometers is representative of angular motion of the head of a user.

According to a further aspect, each of the accelerometers is mounted in or on a respective earpiece.

According to a further aspect, the earpieces are configured for at least partial insertion in respective ears.

Another aspect further includes a processor configured to determine from the acceleration information from both accelerometers angular motion in a generally horizontal plane.

According to a further aspect, the processor is configured to process acceleration information to determine amount and/or direction of angular motion relative to a reference direction, and wherein the accelerometers provide acceleration information indicative of the reference direction.

Another aspect includes an input that is selectively operable by a user to set a reference facing direction, and wherein the processor is configured to determine from reference direction information and acceleration output information substantially the absolute facing direction of a user wearing the earpieces.

Another aspect includes a direction sensing device configured to receive signal information representing a reference direction from a compass or from a satellite based device (e.g., global positioning system (GPS), Galileo navigation system or Glonass navigation system, etc.).

According to a further aspect, the processor is configured to distinguish between angular motion in a generally horizontal plane and motion that is not in a generally horizontal plane.

Another aspect relates to including an input to the processor representing the direction of gravity, and wherein the processor is configured to determine a generally horizontal plane relative to the direction of gravity.

According to a further aspect, the accelerometers are three axis accelerometers configured to provide acceleration information representing acceleration vectors in three orthogonal directions, and wherein the processor is configured to project mathematically the respective acceleration vectors from each accelerometer in a representation of a generally horizontal plane, whereby the projections of the vectors are combinable to indicate magnitude and direction of acceleration of the respective earpieces in the generally horizontal plane to determine angular motion in the generally horizontal plane of the head of a user wearing both earpieces of the audio headset system without regard to orientation of the respective earpieces with respect to the ears of a user.

According to a further aspect, the processor is configured to determine the difference between acceleration information from the two accelerometers that is substantially the same magnitude but of different sign representing rotation of a user's head generally in a horizontal plane compared to acceleration output information from the two accelerometers that is substantially different or is substantially the same but of the same sign and represents motion of a user's head other than a rotation in a generally horizontal plane.

Another aspect relates to including portable electronic equipment connectable to the earpieces to provide signals to the earpieces to provide output sounds to the ears.

According to a further aspect, the portable electronic equipment includes a mobile telephone.

According to a further aspect, the portable electronic equipment is at least one of a music player, video player, navigation device, digital still camera, digital video camera or combination digital still and video camera.

Another aspect relates to a microphone, a microphone housing containing the microphone, the processor and circuitry, wired connections between the circuitry in the microphone housing and speakers of the earpieces.

According to another aspect, the microphone housing contains at least one of an electrical connection or wireless connection to a portable electronic device.

According to a further aspect, the processor is in the portable electronic equipment.

According to a further aspect, the processor is in at least one of the earpieces.

According to a further aspect, the earpieces are connected to exchange signals with respect to the processor by wired connection or by wireless connection.

Another aspect relates to including an audio content source and/or a source of navigation information and wherein the speakers of the earpieces are configured to respond to signals to provide audio output representing the audio content or navigation information to a user wearing the earpieces.

According to a further aspect, the processor is configured to change audio content and/or navigation information based on the facing direction of the user's head wearing the earpieces.

According to a further aspect, the processor is configured to change volume of sounds provided as outputs from respective earpieces based on facing direction of a user wearing the earpieces.

Another aspect relates to a method of determining rotation and/or direction of a user's head wearing a headset including an ear piece at each ear and each ear piece having an accelerometer, including processing acceleration information from both accelerometers to determine angular motion of the user's head in a generally horizontal plane.

According to another aspect the processing includes considering the accelerometers as generally symmetrically located relative to the axis of rotation of the head, and wherein the processing includes using the relative movement of the ear pieces in relation to each other as an indication of angular motion or direction of angular motion.

Another aspect relates to including distinguishing between signals representing angular motion of the head in a generally horizontal plane from signals representing other motion of the head.

According to a further aspect, the accelerometers are three-axis accelerometers, and the processing includes normalizing the acceleration vector signals for each axis from each of the accelerometers to obtain respective horizontal acceleration vector components in a generally horizontal plane, and combining respective horizontal acceleration vector components from each accelerometer to obtain direction and magnitude of acceleration in the generally horizontal plane.

Another aspect relates to including determining the direction of gravity to identify the generally horizontal plane.

Another aspect relates to including providing signals to the respective earpieces to produce sound by the earpieces.

Another aspect relates to including changing at least one of the volume, content or information of the sound by affecting the signals based on the facing direction of a user wearing the earpieces in respective ears.

Another aspect relates to including setting a reference direction based on an input that is selectively provided by a user.

According to a further aspect, the processing is carried out at least partly in at least one of the earpieces.

Another aspect relates to including using a portable electronic device to provide signals to the earpieces to produce sound outputs.

According to a further aspect, at least part of the processing is carried out in the portable electronic device.

Another aspect relates to using a portable electronic device includes using a mobile phone.

Another aspect relates to receiving direction signals information to identify a reference direction from at least one of a compass or a satellite based device (e.g., global positioning system (GPS), Galileo navigation system or Glonass navigation system, etc.) to identify an absolute direction.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

Features that are described and/or illustrated with respect to one embodiment may be used in the same way or in a similar way in one or more other embodiments and/or in combination with or instead of the features of the other embodiments.

It should be emphasized that the term "comprises/comprising" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate like or corresponding parts throughout the several views and may be used to designate like or similar parts in more than one embodiment.

BRIEF DESCRIPTION OF THE DRAWINGS

In the annexed drawings:

FIG. 8 is a schematic flowchart (reference herein to "flowchart" includes a computer program type flow chart) or logic diagram of an embodiment for obtaining a reference direction based on facing a given direction;

FIG. 9 is a schematic flowchart or logic diagram illustrating obtaining a reference direction based on input from a direction determining device;

FIG. 10 is a schematic flowchart or logic diagram illustrating an exemplary embodiment depicting use of an audio headset system in connection with obtaining an output function based on a head gesture, angular motion or the like;

DESCRIPTION

Figure 1:
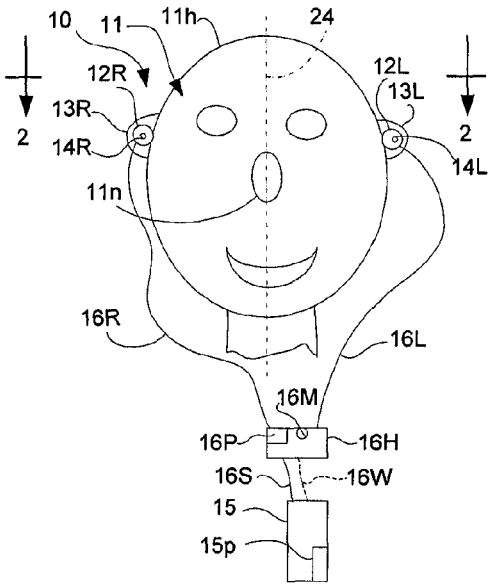
FIG. 1 is a front view of an audio headset system having a pair of earpieces that are positioned in a user's ears.

The interchangeable terms "electronic equipment" and "electronic device" include portable radio communication equipment. The term "portable radio communication equipment," which hereinafter is referred to as a "mobile radio terminal," as "portable electronic equipment," or as a "portable communication device," includes all equipment such as mobile telephones, audio and/or video media players, pagers, communicators, electronic organizers, personal digital assistants (PDAs), smartphones, portable communication apparatus, and others mentioned herein or may come into existence in the future, or the like.

In the present application, embodiments of the invention are described primarily in the context of a mobile telephone. However, it will be appreciated that the invention is not intended to be limited to the context of a mobile telephone and may relate to any type of appropriate electronic equipment, examples of which include a media player, a gaming device, PDA and a computer, and others mentioned herein or may come into existence in the future, etc.

According to an embodiment a direction sensor system associated with a headset uses head movements as gestures to control another device, e.g., a portable electronic devices such as a mobile phone. The sensor system includes a separate accelerometer for each of the two ear pieces of a headset that typically may be used for listening to music, description, sound, audio signals, or other audio content (all these being collectively referred herein to as audio). The ear pieces do not have to be mechanically attached to each other or fixed relative to each other because the location of the ears to which the ear pieces provide audio is known, e.g., on the head of a person who uses the audio headset system. The output information, e.g., electrical signals, which are referred to herein as accelerometer output signals or accelerometer information, may be used to indicate gestures or movements of the head of the user. It is not necessary to restrict design of ear pieces because two accelerometers are used; and they can be used to detect turning motion of the body as the head moves with the body or swiveling of the head relative to the body.

In referring in detail to the drawings like reference numerals designate like parts in the several figures, primed reference numerals designate similar parts that are designated by the same unprimed reference numerals in the several figures. Also, suffix letters L and R may be used with a reference numeral to designate left and right side; and the same reference numeral may be used without such suffix to indicate identify a part that is the same for both the left and right.

Figure 2:
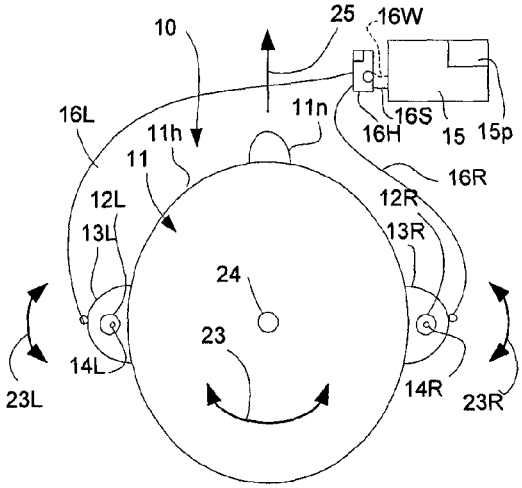
FIG. 2 is a top view looking generally in the direction of the arrows 2-2 of FIG. 1.

In FIGS. 1 and 2, an audio headset system 10 is illustrated in position with respect to a user 11, who may listen to sounds provided by the audio headset system. The sounds may be various audio content, such as, for example, music, podcasts, other information, radio broadcasts, and so on. The audio content may be navigation information. The audio content may be information about an object at which the user 11 is facing or looking. The audio content may be game information, such as sounds, instructions, and so forth associated with a game.

The audio headset system 10 includes a pair of earpieces 12R, 12L that are illustrated in position with respect to respective ears 13R, 13L of the user 11 to provide sounds to those ears. In an embodiment the earpieces are of the type known as earbuds. An earbud typically is a device that is at least partly insertable (or is fully insertable) into an ear of a user to provide sounds that may be listened to by the user. Other types of earpieces may be used to provide sounds to the user. One example is a typical Bluetooth type earpiece that has a support that fits about the outside of an ear between the user's ear and the user's head 11*h*. Other types of earpieces also exist and may be used in the audio headset system 10.

Figure 3:
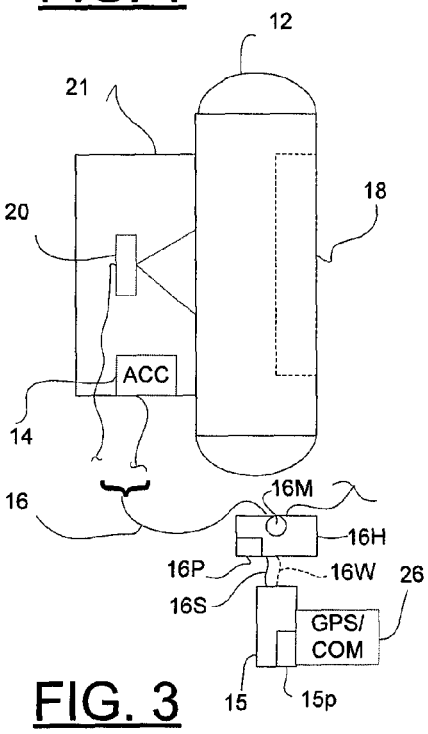
FIG. 3 is a schematic illustration of one of the earpieces of an audio headset system.

The audio headset system 10 includes a pair of accelerometers, which are shown schematically at 14R, 14L in FIG. 1 (and shown at 14R, in FIG. 3). The accelerometers are configured to provide acceleration information representative of acceleration of the respective earpieces. The acceleration information from both accelerometers is used together to provide information representative of angular motion of the head 11*h* of the user 11 in a generally horizontal plane relative to a user who is standing or sitting generally upright, e.g., such that the neck and spine that support the user's head 11*h* are generally vertical. As is described further below the audio headset system 10 discriminates between acceleration in a generally horizontal plane and directions other than in a generally horizontal plane, e.g., those occurring on account of nodding the head forward or backward, tilting the head to a side, or the body of the user leaning or bending. Such discrimination may be based on the sign or polarity of the signals from the respective accelerometers and/or the normalized signals obtained from the acceleration signals produced by the accelerometers and/or from the curve shapes of the acceleration signals from both accelerometers 14R, 14L. For example similar curve shape, but opposite polarity tends to indicate that the acceleration signals are representing angular motion in the generally horizontal plane, as is described further below.

Associated with the audio headset system 10 and in some instances a part of the audio headset system is a source for the audio content. In the illustration of FIGS. 1 and 2 the source for the audio content is shown at 15. The source may be, for example, a portable electronic equipment, such as, for example, a mobile telephone, a music playing device, such as, for example, a WALKMAN radio or music player, a PDA (Personal Digital Assistant), a small computer, and so on. In the interest of brevity, the earpieces 12R, 12L are referred to below as earbuds of the type that may be at least partly or fully inserted in the ears 13R, 13L of the user 11, and the portable electronic equipment 15 may be referred to as a mobile phone. Such mobile phones are, of course, well-known and may be used not only for telephone communication but also message communication, network connection, e.g., Internet browsing, playing of music or other audio content, playing games, and so on.

The earbuds 12R, 12L may be an accessory used in conjunction with the mobile phone 15 to permit the user 11 to listen to music or other audio content provided by the mobile phone. Electrical connections between the earbuds 12R, 12L and the mobile phone 15 may be provided as a wired connection, e.g., provided by one or more wires illustrated at 16R, 16L between the mobile phone 15 and the respective earbuds to provide signals to the earbuds to produce sounds and to provide signals or information from the earbuds to the mobile phone 15. Alternatively, connections between the earbuds and mobile phone may be provided by wireless technology, e.g., Bluetooth technology, WiFi technology, or by a combination of wired and wireless technology, and so on. The mobile phone would typically include a processor 15P, for example, a microprocessor, ASIC (Application-Specific Integrated Circuit), logic circuitry, and so on to carry out the various functions of the mobile phone, including, for example, playing audio content and providing signals or controlling the providing of signals to the respective earpieces so the user 11 may listen.

In earbud accessories usually there is no mechanical connection between the respective earbuds 12R, 12L; rather, they may be attached mechanically and electrically to the respective wires 16R, 16L and, thus, dangle from the ends of those wires relatively freely. The earbuds, though, may be placed conveniently in the ears 13R, 13L quite easily without impediment of a mechanical connection between them such as, for example, a relatively rigid bar or strap that typically is used in headphone type devices, where the bar or strap goes over the head of the user and holds the speaker portions of the earphones in place relative to the ears of the user. With earbuds there is no bar or strap that may cause discomfort to the user, may take substantial space for carrying or storing the earphones or may break. In contrast the earbuds and wires associated with them are relatively small, the wires typically are flexible, and an earbud accessory relatively easily may be stored in a small space and has virtually no rigid parts subject to breakage, such as, for example, the bar or strap of conventional earphones.

As is illustrated schematically in FIGS. 1 and 2, the wires 16R, 16L may be coupled to a microphone housing 16H, which houses a microphone 16M to pick up sounds, e.g., voice, as a user 11 speaks. The voice signals may be conveyed to the mobile phone 15 via a wired connection, which is represented by a solid line 16S, or via a wireless connection, which is represented by a dash line 16W, e.g., using Bluetooth technology, WiFi technology, and so on, components of which may be in the microphone housing 16H.

A processor 16P also may be included in the microphone housing 16H. The processor 16P may be configured to carry out processing of acceleration signals and information as is described herein, for example.

Figure 4:
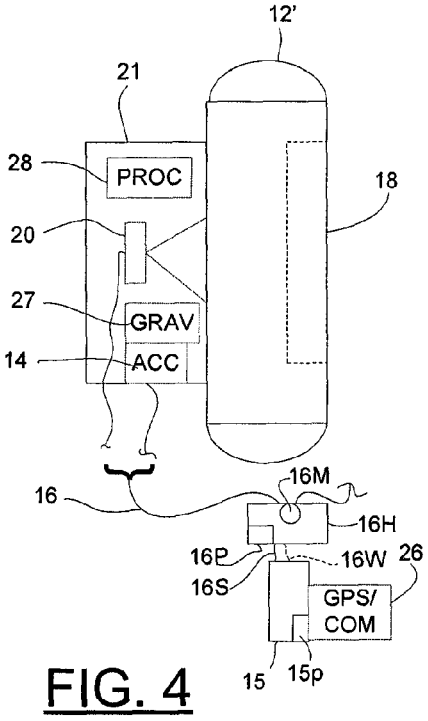
FIG. 4 is a schematic illustration of another embodiment of earpiece.

Referring to FIG. 3, an earpiece 12 is illustrated. The earpiece 12 is in the form factor of an earbud and represents an example of each of the earbuds 12R, 12L in FIGS. 1 and 2. FIG. 4 illustrates another embodiment of earbud 12', which may be used as each of the earbuds 12R, 12L illustrated in FIGS. 1 and 2. The earbuds 12, 12' include a speaker 20 configured to provide audio output from the earbud and a housing 21. The speaker is mounted with respect to the housing, for example, inside the housing or on a surface of the housing, and the housing is configured for positioning with respect to an ear of a user to direct audio output (sounds) from the speaker to the ear. The housing 21 and earbud 12 or 12' may be configured to permit the entire earbud to be inserted into the outside portion, e.g., of the ear canal, of an ear 13 of the user 11 (FIG. 1). Alternatively, the housing and earbud may be configured to be partly inserted into the ear. As another alternative, the earbud may be of a design that is mounted outside the ear but relatively adjacent or relatively proximate the opening to the ear canal so that the user 11 may easily listen to sounds provided by the earbud.

In FIG. 2 such angular motion is represented by the arrow 23. The angular motion 23 is, for example, angular motion in a generally horizontal plane, considering, for example, that the user 11 is sitting upright or is standing upright, and the axis of rotation 24 about which the rotation occurs is, for example, approximately the center line of the neck and spine of the user. Thus, the angular motion may be, for example, simply turning of the head to the left or to the right relative to a front facing direction, such as the front facing direction represented by the arrow 25 illustrated in FIG. 2. The front facing direction may be, for example, the direction that the head faces and the nose 11*n* of the head points or faces when the user 11 is facing forward relative to the shoulders, e.g., approximately perpendicular to the shoulder line of the user. In FIG. 2 arrows 23R and 23L represent the angular motion of the respective earpieces 12R, 12L as the user rotates the head 11*h* in the direction of the arrow 23, e.g., rotating away from or back toward the front facing direction 25. The angular motion of respective earpieces 12R, 12L also may occur as the user 11 rotates his entire body including the head 11*h* from facing in one direction to another.

The locations of the earpieces 12R, 12L relative to each other is known, as they are placed proximate to, at or in the ears 13R, 13L; and the location of the ears is fixed relative to each other and relative to the axis of rotation 24 of the head 11*h*. If desired, the earpieces 12R, 12L may be mounted on a relatively rigid bar or strap, while still being in proximity, at or in the ears and functioning as described elsewhere herein, but such mounting is unnecessary to carry out the invention. Rather, the invention permits the described functioning while using the head as the mounting structure for the earbuds.

Each of the accelerometers 14R, 14L is positioned with respect to an earpiece 12R, 12L to sense acceleration as the head 11*h* is moved. For example, the accelerometers 14 may be mounted in or on a respective earpiece 12. In the illustrations of FIGS. 3 and 4, the accelerometers 14 are mounted in the housing 21 of a respective earpiece 12, 12'. Earbuds are relatively small devices. Three-axis accelerometers also may be relatively small devices that can be mounted in or on the housing 21 of the earbud relatively conveniently without having to redesign the form factor of the earbud.

As is seen in FIG. 3, the mobile phone 15 includes a direction determining device, such as, for example, a global positioning system signal receiver system or compass 26. These are discussed further below.

As is illustrated in FIG. 4, the earpiece 12' includes a gravity sensor 27. The earpiece 12' also includes a processor 28, such as, for example, a microprocessor, ASIC (Application-Specific Integrated Circuit), other logic circuitry, and so on, configured for processing signals, information and so on, as is described in further detail below. Processing described herein may be carried out in one or both earpieces 12R, 12L, in the mobile phone 15, in the microphone housing 16H, or in two or more of the mobile phone, one or both earpieces, and/or the microphone housing, e.g., by processors 15P, 16P and/or 28 and associated circuitry and/or programs, instructions, logic, and so on.

Each of the earpieces 12R and 12L in the headset 10 contains an accelerometer 14. As the earpieces move in relation to each other, the accelerometers 14R, 14L will give information about the rotation, e.g., angular motion, of the user's 11 head 11*h*. The headset 10 utilizes the fact that the user's ears 13R, 13L are generally placed symmetrically on the head 11*h* in relation to the axis of rotation 24, e.g., neck and spine, and, therefore, signals generated by the accelerometers 14 due to rotation of the head 11*h* in a generally horizontal plane can be distinguished from other movement of the head, such as, for example, nodding, jumping and other linear movements like traveling, and so on.

In using the audio headset system a user 11 may place the earbuds 12 in the respective ears 13. Wired or wireless connection may be provided between the mobile phone 15 and the earbuds whereby the mobile phone provides signals to the earbuds to play music or audio content, for example, for the listening pleasure of the user. If the user rotates his head 11*h*, the accelerometers 14 in the earbuds will sense the acceleration and provide signals that may be processed, e.g., analyzed, by the processor that is configured with various computer program software, logic, associated circuitry, and so on to determine the direction of rotation and the amount of rotation, e.g., 10° to the right from the forward facing direction 25, or 10° to the left of the forward direction, or first 10° in one direction away from the forward direction and then a prompt or gradual return to the forward direction, and so on.

The earbuds 12R, 12R' in FIGS. 3 and 4 are illustrative of not only the right side earbuds but also the left side earbuds. Stated another way both earbuds 12R and 12L may be identical and both earbuds 12R' and 12L' (the latter not shown) may be identical. However, as a result of the pair of earbuds being identical, when they are placed in the ears 13R, 13L, the respective accelerometers associated with the respective earbuds in effect face opposite directions. For example, signals from 3-axis accelerometers 14R, 14L may be resolved to represent acceleration in the generally horizontal plane, e.g., in the direction of the arrow 23 and the arrows 23L, 23R horizontally about the axis 24 (FIG. 2), and the resolved signals will be of opposite polarity relative to the front facing direction 25. For example, with reference to FIG. 2, angular motion in a clockwise direction moves the accelerometer in the left earpiece 12L in a forward direction, e.g., toward the arrow 25; and the accelerometer in the earpiece 12R would be moving away from or in the opposite direction of the arrow 25, e.g., in a direction toward the back of the head 11*h*. If the accelerations sensed by the accelerometers 14 in the left and right earpieces 12L, 12R are caused by motion only in the horizontal plane about the axis 24, acceleration signals representing such angular motion as sensed by the respective accelerometers would be approximately the same magnitude, curve-shape, and duration, except they would be of opposite sign, e.g., one being positive and the other being negative. The graph and curves illustrated in FIG. 5 are exemplary of such acceleration signals as sensed by left and right accelerometers in the respective left and right earpieces 12L, 12R as is discussed further below.

As is illustrated in FIG. 4, a gravity sensor 27 may be provided in the earpieces 12 or 12'. Knowing the direction of gravity, e.g., vertical, more specifically, downward, it is possible to determine a generally horizontal plane, as is described in further detail below with respect to FIGS. 7A-7E. The gravity sensor 27 may be a separate sensor device, e.g., a separate accelerometer from the accelerometer 14 or it may be the accelerometer 14 itself. Gravity is represented by an acceleration value of, for example, at sea level approximately 32 feet per second squared or approximately 978 centimeters per second squared. The acceleration due to gravity may change based on altitude and also based on degrees latitude over the earth. Knowing the downward direction due to gravity, a generally horizontal plane would be perpendicular to that downward direction.

In contrast to the signals obtained due to angular motion in the horizontal plane as a user 11 turns his head or rotates his body and head 11*h*, if the user were to nod the head forward or backward, both accelerometers will produce the same accelerometer output signals, but the signals will be mirrored because one accelerometer is in the left ear and one is in the right ear. Also, if the user 11 were to tilt his head left or right, one accelerometer would move a large distance and undergo a substantial acceleration, whereas the other accelerometer would move a smaller distance and undergo a smaller acceleration.

The accelerometers may be one-axis, two-axis or three-axis accelerometers. In the present invention three-axis accelerometers are used, as they are relatively easily available, relatively inexpensive, and versatile to provide the acceleration information useful as described herein.

Figure 5A:
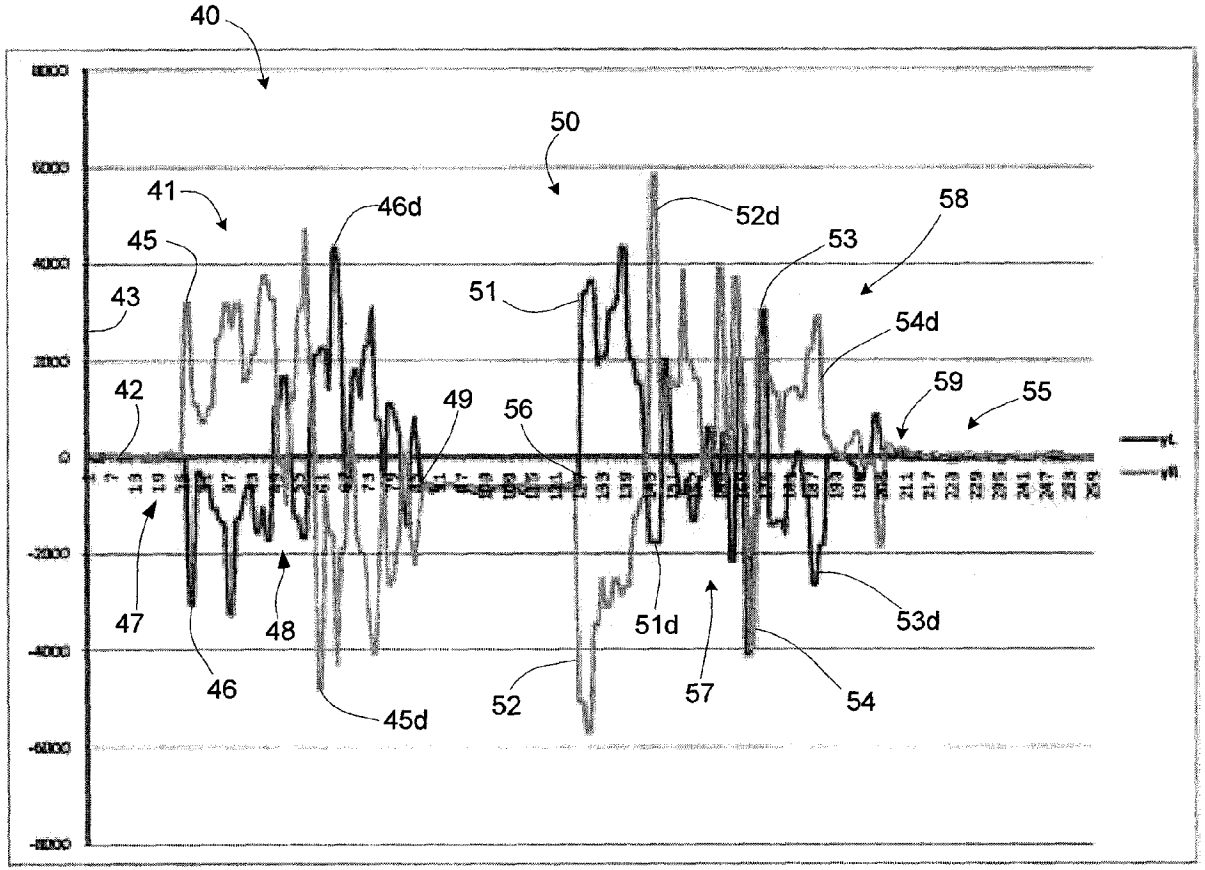
FIG. 5A is a schematic graphical illustration of signals received from a pair of earpieces of an audio headset system, for example, of the type illustrated in FIGS. 1-4.

Turning to FIG. 5A, a graph 40 illustrates respective accelerometer signals generally shown at 41. The signal from one accelerometer is represented by relatively dark shade of black lines and the signal from the other accelerometer is represented by a relatively lighter shade of black or gray. The accelerometer signals are shown occurring along a time line or axis 42 at respective magnitudes above and below a zero signal level, the magnitudes and zero signal level being represented on a magnitude axis 43. Relative to a typical conventional graph, the time axis 42 is analogous to the "x" axis and the magnitude axis 43 is analogous to the "y" axis of the graph 40.

Figure 5B:
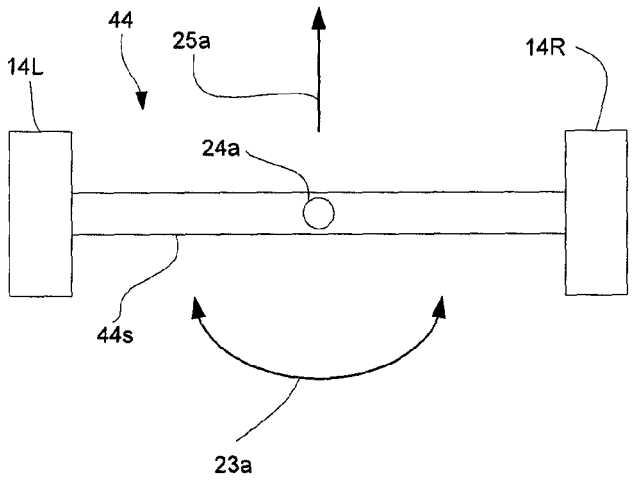
FIG. 5B is a schematic illustration of a test rig demonstrating operation of the invention to generate curves of FIG. 5A.

The acceleration signals 41 illustrated in the graph 40 of FIG. 5A are obtained, for example, from a test rig 44 that is shown in FIG. 5B. The test rig 44 includes a pair of accelerometers 14L, 14R, which are mounted at opposite ends of a linear shaft 44*s* that is rotatable about an axis 24A, e.g., analogous to the axis 24 illustrated in FIG. 2. Rotating the shaft 44*s* clockwise or counter clockwise, as is represented by the arrow 23*a*, the respective accelerometers produce respective acceleration signals relative to the forward facing direction 25*a*. The initial positioning of the shaft 44*s* and the accelerometers 14L, 14R on the shaft is representative of the accelerometers 14L, 14R of the earpieces 12L, 12R illustrated in FIG. 2. Therefore, relative to the forward facing direction 25*a*, the shaft 44*s* initially is generally perpendicular to that direction and is perpendicular to the axis 24*a*. Rotating of the shaft 44*s* with accelerometers 14R, 14L simulates operation of the audio headset system 10, e.g., as is illustrated in FIGS. 1 and 2. The Test rig 44 may use single axis accelerometers to facilitate demonstrating operation to obtain the curves in the graph 40 of FIG. 5A. Operation with 3-axis accelerometers would be similar. Also, the accelerometers 14R, 14L on the test rig may be electrically coupled in opposite polarity to obtain the signals illustrated in the graph 40 of FIG. 5A.

The graph of FIG. 5A shows signals from two accelerometers that are mounted on the ends of a shaft. The shaft is rotated about a vertical axis such that the accelerometers rotate in a horizontal plane. The accelerometers may be one-axis, two-axis or three-axis accelerometers; but the graph is a representation of using one-axis accelerometers or using multiple-axis accelerometers while using signals from the output representing only one axis of motion. The accelerometers are electrically connected in opposite polarity relation to output circuitry so that during clockwise rotation about the axis, the polarity of one signal is positive and the polarity of the other signal is negative. As the direction of rotation reverses, the polarities reverse. The acceleration signals shown in the graph are shown as amplitude of over time; time is represented on the horizontal axis in the drawing. The amplitude may represent acceleration data. Motion data, e.g., the extent of motion of an accelerometer, may be the integral of acceleration over time.

Rotating the shaft 44*s* in a clockwise direction causes the accelerometer 14L initially to show acceleration occurring in the direction of the forward facing arrow 25*a*, and an acceleration signal 45 (FIG. 5A) that is on the positive side of the time axis 42 is produced during such acceleration. At the same time the acceleration signal 46 is produced by the accelerometer 14R, such acceleration signal being the same shape as the acceleration signal 45, but being on the negative side of the time axis 42. Thus, the signals 45, 46 are substantially the same shape and magnitude, but of opposite sign. As the shaft 44*s* slows and eventually stops, the accelerometers 14L, 14R (FIG. 5*b*) decelerate. Therefore, the acceleration signal 45*d* produced by the accelerometer 14L appears at the negative side of the time axis 42, and the acceleration signal 46*d* provided by the accelerometer 14R occurs at the positive side of the time axis 42. The shape of the respective acceleration signals 45*d*, 46*d* is approximately the same, but, as before, the sign is different. The acceleration signals go to zero when the shaft 44*s* stops rotating.

The above-described acceleration signals are with respect to clockwise rotation of the shaft 44*s* from zero or stand-still represented, for example, at 47 on the graph 40, showing the acceleration signal 41; the rotation tends to slow down at the area 48, where the polarity of the acceleration signals 45, 46 switches to opposite and, thus, the acceleration signals are shown, respectively, at 45*d*, 46*d*. At location 49 along the time axis 42, the shaft 44*s* has come to a stop. No acceleration signal in the horizontal plane would occur, and, therefore, the acceleration signals would be, for example, at a zero level relative to the y axis 43.

The shaft 44*s* may be rotated back to the starting position mentioned just above whereby the shaft 44*s* is perpendicular to the forward facing direction 25*a*. In such case, as the shaft 44*s* is rotated in a counter clockwise direction relative to the axis 24*a*, signals of the type described above may occur, except that the relation of the acceleration signals provided by the accelerometers 14L, 14R would be opposite polarity to the polarity described above. Thus, during initial acceleration the acceleration signal from the accelerometer 14R may be on the positive side of the time axis 42, as the acceleration signal provided by the accelerometer 14L may be on the negative side of the time axis; and those polarities would reverse as the shaft 44*s* slows to stop at an orientation such that it is perpendicular to the forward facing direction 25*a*.

The examples just described are representative of operation of the headset 10 as it is used with the accelerometers 14R, 14L thereof to provide information representative of the angular motion of a user's head in one plane, e.g., a horizontal plane. The manner in which the acceleration signals 45, 46, 45*d*, 46*d* are obtained is described further below with respect to FIGS. 7A-7E, for example.

The acceleration signals 50 shown generally at the right-hand portion of the graph 40 also illustrate exemplary operation of the headset 10 and the acceleration signals obtained, for example, when a user rotates his head 11*h* in one direction and then in another direction. For example, acceleration signal portions 51, 52 represent acceleration of the two accelerometers 14L, 14R (FIG. 5B) as the shaft 44*s* is rotated in one direction; and acceleration signal portions 51*d*, 52*d* represent deceleration. Acceleration signal portions 53, 54 represent returning of the shaft 44*s* toward its original start position, and acceleration signal portions 53*d*, 54*d* represent slowing. Acceleration signal portions shown generally at 55 represent a possible overshoot and return to the forward facing orientation mentioned above. The acceleration signal portions 55 alternatively may represent a bit of extra motion, e.g., acceleration/deceleration to bring the shaft 44*s* to a desired orientation relative to the forward facing direction. Thus, it will be appreciated that the acceleration signals 50 represent rotation from a start position represented at 56 along the time axis 42, a deceleration in the general area 57, a reversal in the area 58, and a stopping in the area 59.

In the described example the rotation is considered as occurring only in a horizontal plane, e.g., a plane that is generally perpendicular to the acceleration direction of gravity, such as down direction, as the person is standing or sitting upright and the head and/or body swivel or rotate while maintaining such upright orientation. However, it will be appreciated that the features of the invention may be used even if the motion is not in or is not only in the horizontal plane, as is described elsewhere herein.

Figure 6:
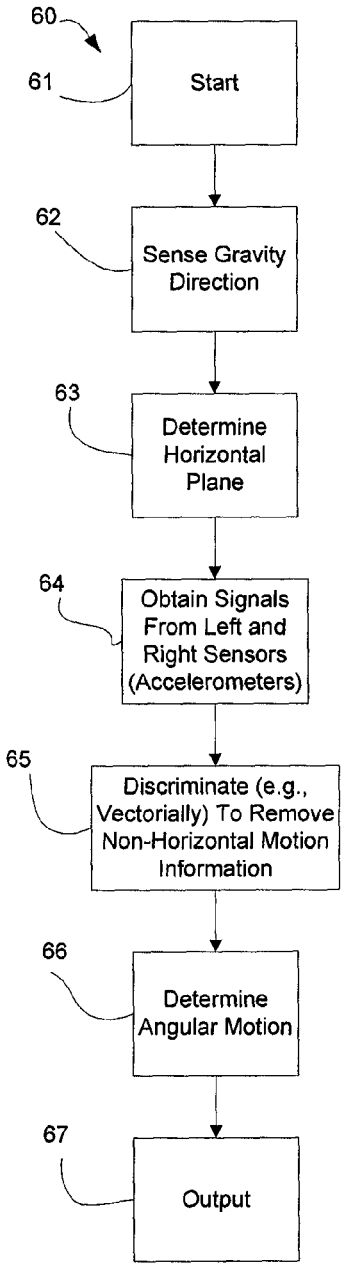
FIG. 6 is a schematic flowchart or logic diagram illustrating an example of operation of an audio headset system according to an exemplary embodiment.

Turning to FIG. 6, a computer program flowchart or logic diagram illustrates exemplary steps in which the audio headset system 10 may be used. The logic diagram 60 starts at step 61. For example, the audio headset system is turned on and desired operation is set by the user. At step 62 the gravity direction is sensed, as was mentioned above and as is described in greater detail below. At step 63 the horizontal plane is determined based on knowing the gravity direction. At step 64 signals are obtained from the left and right sensors, e.g., the respective accelerometers 14L, 14R. Since the accelerometers are three-axis accelerometers, the acceleration signals produced by them are in three orthogonal directions. The acceleration signals may be vectors pointing in those respective orthogonal directions and having magnitudes representative of the acceleration in those respective directions. The acceleration information is processed, as will be described below with respect to FIGS. 7A-7E, for example, to remove non-horizontal motion or acceleration information, as is indicated at step 65.

At step 66 angular motion in the generally horizontal plane is determined. This can be determined, for example, by combining the projections of the respective three orthogonal vectors in the horizontal plane, as is described with respect to FIGS. 7A-7E. At step 67 the angular motion information is output for use, as is described further below.

Reference is made to FIGS. 7A-7E illustrating the manner in which the acceleration signals from the two three-axis accelerometers 14L, 14R may be normalized or resolved to obtain angular motion information in the generally horizontal plane.

Whether the three-axis accelerometers 14L, 14R are positioned identically in the respective earbuds 12L, 12R or whether they are randomly mounted in or on the respective earbuds, the orientation of the two accelerometer axes may not be aligned with each other, i.e., the x, y and z axes of one accelerometer may not be generally parallel to the respective x, y and z axes of the other accelerometer. This may be due to the fact that the accelerometers are not identically mounted or positioned on or in the respective earbuds or may be due to the different orientations of the earbuds in the respective ears 13 of the user 11. One earbud and the accelerometer thereof may be oriented with respect to an ear differently from the orientation of the earbud and accelerometer positioned with respect to the other ear of the user 11. The steps for in a sense normalizing the acceleration signals from the respective three-axis accelerometers, as are described with respect to FIGS. 7A-7E provide for the use of the earbuds with accelerometers without concern for the precise orientation of one accelerometer relative to the other.

Thus, the orientation of the axes of the two accelerometers 14L, 14R may not be aligned, and, therefore, the data from the accelerometers cannot be used directly. Rather, the data has to be in a sense aligned, e.g., normalized, and the description below provides an example for obtaining such alignment (e.g., normalization or normalizing of the data). In the instant description here the interest is in obtaining acceleration information in the horizontal plane to be used for calculating the angular motion or rotation of the accelerometers, earbuds, and user's head, e.g., about the axis 24 (FIG. 2).

Figure 7A:
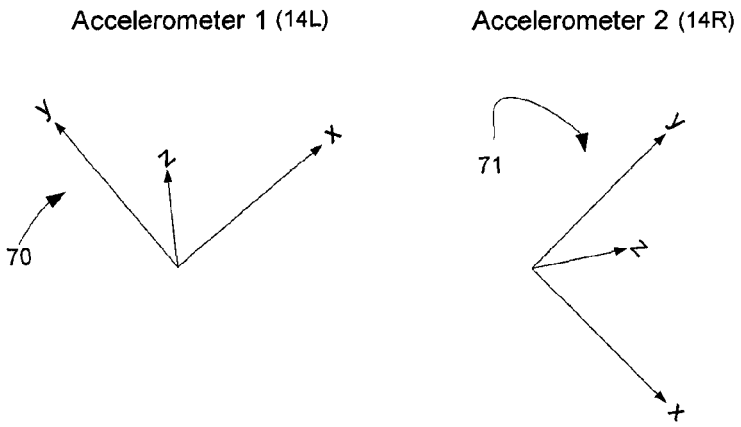
FIGS. 7A-7E illustrate examples of acceleration vectors obtained using a pair of earpieces with 3-axis accelerometers.
Figure 7B:
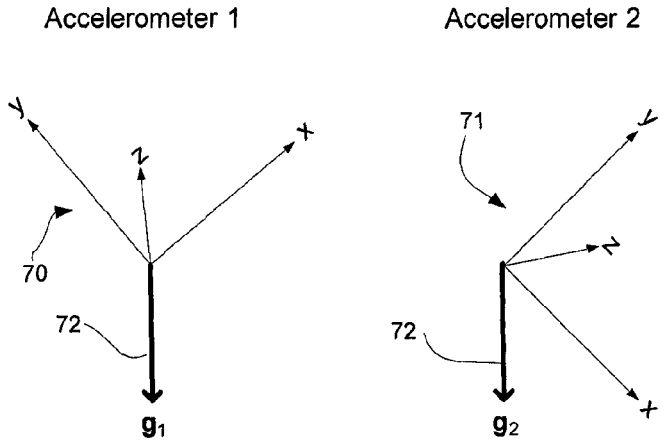

FIG. 7A illustrates an example of the orientation of the x, y and z axes of accelerometer 1, e.g., accelerometer 14L, and of accelerometer 2, e.g., accelerometer 14R. FIG. 7B illustrates the vector of gravity, e.g., the acceleration vector representing gravity, which is represented at 72 with respect to the x, y and z axes 70, 71 of the left and right accelerometers 14L, 14R, for example. The direction of gravity, e.g., the acceleration vector 72, may be determined by a separate sensor, e.g., a separate accelerometer such as is shown at 27 in FIG. 4, or it may be determined by the accelerometers 14L, 14R. For example, since gravity is substantially constant and pointing in the same direction at all times, e.g., approximately toward the center of the earth, the accelerometers 14L, 14R may provide a constant output signal or bias signal representing the direction of gravity. Such constant signal may be, for example, a direct current signal of constant magnitude and direction.

Figure 7C:
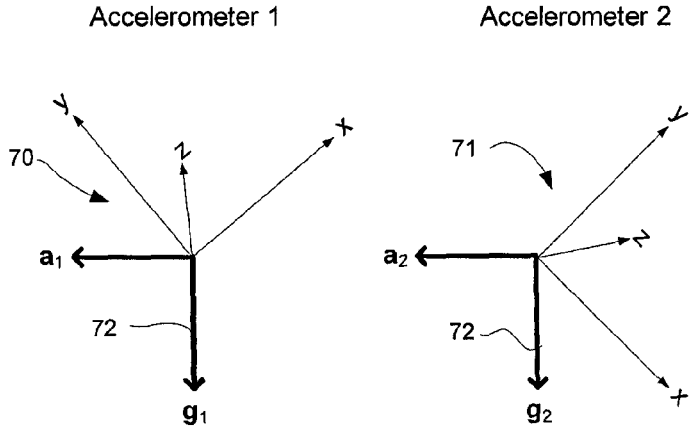

In FIG. 7C a calculation is represented to obtain the vectors $a_1$ and $a_2$ that are perpendicular to the direction of gravity 72.

Figure 7D:
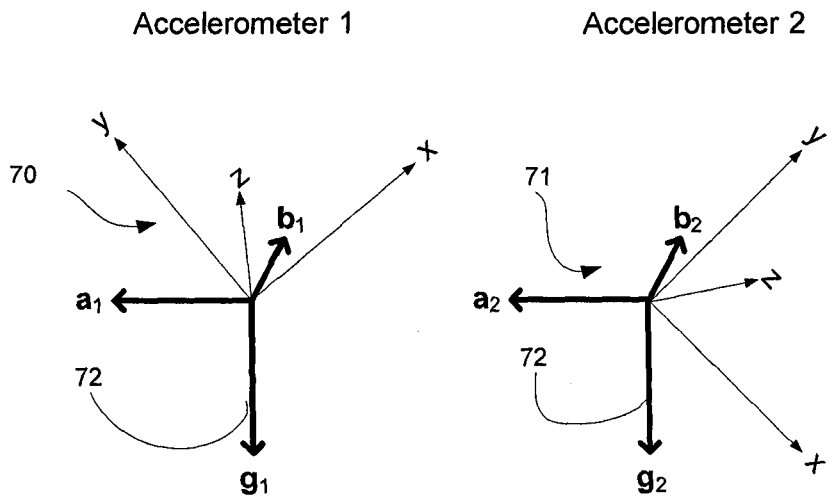

Referring to FIG. 7D, the next step is to calculate the cross product between the vector a and the vector g (gravity) to obtain the vector b. As is illustrated in FIG. 7D, the cross products are calculated for the left accelerometer 14L using vectors $a_1$ and $g_1$ to obtain the vector $b_1$. Similarly, for the right accelerometer 14R, the vectors $a_2$ and $g_2$ are used in calculating the cross product to obtain the vector $b_2$. The vectors a and b define the horizontal plane are perpendicular to each other and to the gravity vector. Sometimes the horizontal plane to is referred to herein as "generally horizontal plane" due to the possibility that the computations may not be precise, e.g., due to the manner in which the user 11 carries himself (upright or not fully upright) or there may be some variation in gravity, e.g., due to some type of interference or distortion as may affect the gravity determination by the sensor (accelerometer 27 or the accelerometers 14R, 14L) of gravity in the respective earbud(s).

Figure 7E:
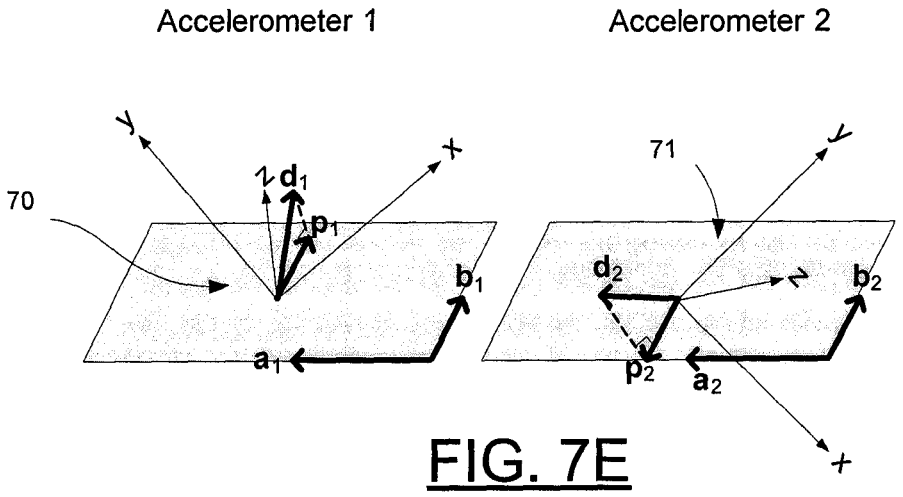

Turning to FIG. 7E, from the a and b vectors calculate the projection matrix to provide the horizontal plane and project the data d down to the horizontal plane to obtain the horizontal acceleration component p. For the left accelerometer 14L, the subscripts of the vectors a, b, d and p are the number "1." For the right accelerometer 14R, the subscripts are the number "2," as is illustrated in FIG. 7E. The projection matrix represents the acceleration components in the x, y and z directions to obtain the vector d of a magnitude and direction represented by the combination of vector signals or accelerations in the respective x, y and z directions for the respective accelerometer. The data represented by the vector d includes direction and magnitude, and it is projected onto the horizontal plane that is represented by the vectors a and b, as is illustrated in FIG. 7E.

It is seen that the projection of the vector $d_1$ onto the horizontal plane for accelerometer 14L is in the direction $p_1$ of a given magnitude. Similarly, the projection of the vector $d_2$ into the horizontal plane for the accelerometer 14R is in the direction $p_2$ that is opposite the direction of the vector $p_1$ and is approximately of the same magnitude as the vector $p_1$. Thus, with reference both to FIG. 7E and to FIG. 5A, the vectors $p_1$ and $p_2$ represent the respective magnitudes of the acceleration signals 45, 46, for example, those magnitudes being approximately the same and of opposite sign relative to the graph 40 of FIG. 5A and relative to the facing directions illustrated in FIG. 7E for the vectors $p_1$ and $p_2$. The horizontal components $p_1$ and $p_2$ can be used for calculation of the angular motion or rotation of the head 11*h* of the user 11 who is wearing the earbuds 12R, 12L of the audio headset system 10 in operation, for example. As an example, the calculation may include a second integration of the respective vector p with respect to time, since the respective vector $p_1$ or $p_2$ is an acceleration vector, and the first integration is velocity, while the second integration is distance or extent of rotation. Appropriate constants may be used to account for the rotational or angular character of the motion.

Other computations also or alternatively may be used to obtain the amount of angular motion.

As another example to obtain angular motion information using three-axis accelerometers, obtain each accelerometer the output signal for each axis, e.g., respectively referred to as the x, y and z axes. For convenience of this description the accelerometer output signals are referred to as S1, S2 and S3, and these output signals are respective vectors having magnitude and direction.

The ear pieces may be inserted in the user's ears in random orientation. There is no need to assure that they are inserted in a manner such that they "face" in a given direction, e.g., such that the respective accelerometers are oriented in a known direction. Thus, the horizontal plane, i.e., the plane that is perpendicular to the direction of gravity (the term "gravity" also may be referred to as vertical direction or direction of gravity, as will be evident from context) is not known from the position of the ear pieces with respect to the ears of a user.

However, by using gravity as an indication of a vertical direction, the horizontal plane, e.g., generally parallel to the earth at the current location of the user, may be determined. The horizontal plane would be perpendicular to the direction of gravity.

The S1, S2 and S3 output signals from each respective accelerometer are vectors in that each represents a signal magnitude and a respective direction that is parallel to the x, y or z axis of the accelerometer. The respective vectors may be projected onto the horizontal plane, which may be determined as was described above. This projecting may be done mathematically so as to identify in the horizontal plane the magnitude of projected portion of the respective vector that is in the horizontal plane. Those magnitudes and respective vector directions in the horizontal plane are represented as S1*h*, S2*h* and S3*h*.

The three vectors S1*h*, S2*h* and S3*h* may be vectorially combined as a vector sum that represents the acceleration of the respective ear piece in the horizontal plane.

The signals from the two accelerometers may be combined to identify the direction and extent of a gesture or angular motion of the user's head 11*h*.

A compass can provide direction information. A global positioning system, sometimes referred to as GPS, and satellite-based navigation systems, such as those referred to as Galileo navigation system or Glonass navigation system also can provide direction information. Absolute direction may be, for example, the direction north or some other relatively precise direction. Accelerometers used alone will not give information about absolute direction. However, techniques may be used in accordance with an embodiment of the invention to obtain an absolute direction. For example, a reference direction obtained from a compass, from a GPS system or from a navigation system, such as those just mentioned, may be used to identify a reference direction by providing signals to the audio headset system 10; and by determining angular motion relative to the reference direction, an absolute direction that the user may be facing can be obtained. Such signals representing absolute direction may be provided the audio headset system 10 during an initialization or calibration at the startup and/or during use of the audio headset system 10. After a while there might be some drift that has to be compensated, for example, as the actual angular motion may be slightly inaccurate as it is measured based on the accelerometers and calculated, for example, as is discussed above relative to FIGS. 7A-7E. Some drift may occur as the user's head may nod, bend side to side, or the user's body may bend, and so on all of which may have an impact on the acceleration information sensed by the accelerometers and provided by the accelerometers for use in the manner described above. The initialization and calibration just mentioned could be carried out automatically as part of normal usage of the audio headset system. For example, if both accelerometers are moving in the same direction for some relatively long time, it can be assumed that the user is traveling and that the user's head 11*h* is directed forward in the direction of movement. Information from a GPS, navigation system, or compass that may be provided the audio headset system, e.g., such information may be obtained from the mobile phone 15 that has such GPS, navigation and/or compass capabilities, will then give the audio headset system an absolute value of the direction of travel of the user. Angular motion of the head 11*h* then may be compared to the absolute direction of travel as just mentioned or the reference direction obtained during such traveling thereby to know an absolute direction relative to such reference direction as the head is turned, and so forth.

The travel direction may be based on walking in a straight direction, and outputs from the audio headset system may be used as an electronic pedometer. A pedometer algorithm may be used to exclude the possibility that the user is traveling backwards on a train.

Figures 8, 9, 10:
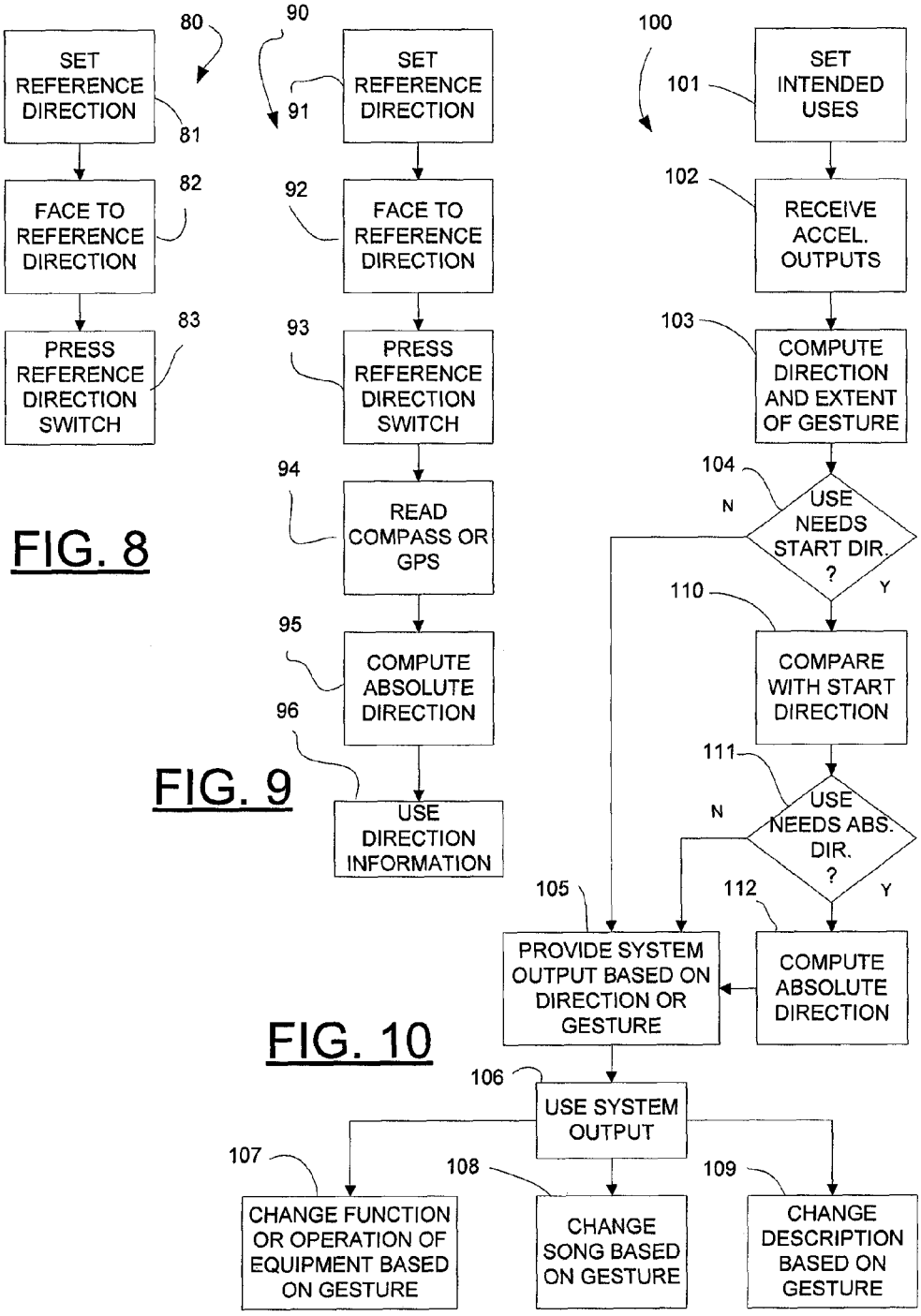

FIG. 8 is a flowchart or a logic diagram 80 representing, for example, steps for setting a reference direction for the audio headset system 10. At step 81 the user may determine that it is intended to set a reference direction. At step 82 the user may face a reference direction. For example, the user may face north or some other known reference direction. At step 83 the user may press a reference direction switch of the audio headset system 10, e.g., a switch located on an earpiece, a switch located on the mobile phone 15, and so forth. Pressing the switch may provide a signal to the audio headset system indicating that the reference direction, e.g., north, is being faced by the user, e.g., the direction represented by arrow 25 (FIG. 2) may be to the north. From that point forward, then, subsequent angular motion of the head 11*h* may be compared by the audio headset system 10 to provide an absolute facing direction, e.g., a number of degrees away from north, e.g., 15 degrees to the east from north, 180 degrees from north, e.g., facing south, and so forth.

FIG. 9 illustrates another example of a flow chart or logic diagram for setting a reference direction for the purpose of determining an absolute direction that the user 11 is facing. At step 91 of the logic diagram 90 the user may indicate to the audio headset system 10 the intention to set a reference direction for use in obtaining absolute direction. That indicating of the intention to set a reference direction may be carried out by the user pressing a switch, button, key or the like on the mobile phone 15 or on one of the earpieces 12 to initiate an application (APP) to configure the audio headset system 10 to carry out the following steps. At step 92 the user may face a reference direction, which may be, for example, facing an object in a display, at a museum, in a park, and so forth. At step 93 the user may press a reference direction switch indicating that the current facing direction is a reference direction from which subsequent angular motion occurrences may be compared.

At step 94 a compass, GPS, navigation system, and so forth may be read in the sense that signals provided from such a device may be received as inputs to the mobile phone 15, for example, to indicate a known direction. At step 95 the absolute direction toward which the user is facing may be computed by determining the difference between the facing direction and the information from the GPS, etc. Knowing the absolute direction, then, such information may be used (step 96) for various purposes. Examples are described further below with respect to FIG. 10.

Referring to FIG. 10, a flowchart or logic diagram 100 illustrating a method of using the audio headset system 10 and configuring of the various components of the audio headset system 10, e.g., the processor, associated memory, computer program software, logic steps, etc. is illustrated.

In the logic diagram 100 at step 101*a* user 11 may set the one or more intended uses of the audio headset system and the angular motion information obtained by the audio headset system. At step 102 acceleration outputs from the respective accelerometers 14L, 14R may be received, and at step 103 the direction and extent of angular motion, of a gesture, etc. is computed, for example, as was described above with respect to FIGS. 7A-7E. At step 104 an inquiry is made whether the use selected or set at step 101 requires a start direction, e.g., a reference direction or start direction from which angular motion may be compared. If the answer is no, then at step 105 the output from the audio headset system 10 is provided based on the direction or gesture that was determined, e.g., as was described above with respect to FIGS. 7A-7E. Then at step 106 the system output, e.g., the angular motion information is used. Various uses are exemplified in FIG. 10. For example, at step 107 the function or operation of the audio headset system 10 may be changed based on a gesture, such as, for example, a quick rotation of the head to the left or to the right and then back to front again or simply a quick rotation without concern for the subsequent return. Another gesture may be a quick rotation in one direction and a slow return to the original facing direction. Other possibilities also exist. The change in function may be, for example, changing from the audio headset system playing music to the user to the audio headset system providing navigation information or playing a game. The gesture also may be used as an input to the game as it is being played.

As another alternative, the use of the system output from step 106 may be the changing of a song based on a gesture, as is represented at step 108. Thus, a rotation of the user's head in one direction may cause the next song in a sequence of songs to be played by the audio headset system 10, and a rotation of the head in the opposite direction may repeat the playing of the current song or an immediately preceding song. Several sharp rotations may be used to step through a sequence of songs in one direction or another, e.g., depending on the direction of rotation, the speed of rotation and/or return to an original facing direction, and so on.

Another use of the system output from step 106 may be the changing of description based on the gesture, as shown at step 109. For example, the user 10 may be viewing one exhibit in a museum and listening to information pertaining to that exhibit. A gesture may cause the information being played to the user to be changed. For example, if the user were to turn his head to the right to face a different exhibit, information concerning that different exhibit may be played via the audio headset system 10. Alternatively, a rotation of the head to the left may cause the audio headset system to play information pertaining to an exhibit relatively to the left as compared to the original facing direction of the user. As still another example, a user may be looking at an object, such as a painting, sculpture, display, etc., and be listening to information concerning that object; then, when the user turns his head to look at another object, such turning is sensed, and the audio content may be changed by operation of the processor, for example, to play a information about the other object.

The description just above concerning the logic diagram 100 does not require a start direction although a reference direction may be set, for example, as described above with respect to the logic diagrams 80, 90 in FIGS. 8 and 9, if desired. However, if a start direction is needed, as determined at step 104 in the logic diagram 100 of FIG. 10, then at step 110 a start direction is obtained, e.g., using the steps in the logic diagrams 80 or 90 in FIG. 8 or 9 or in some other manner. At step 111 an inquiry is made whether the use, as set at step 101, requires an absolute direction rather than just a start direction. If an absolute direction is required, then at step 112 the absolute direction is computed, for example, as was described above with respect to FIG. 9. The logic diagram 100 then proceeds to step 105 and the subsequent steps 106-109, depending on the intended use at step 101. Also, it will be appreciated that the absolute direction may be recalculated or appropriately adjusted as was described above.

Figure 11:
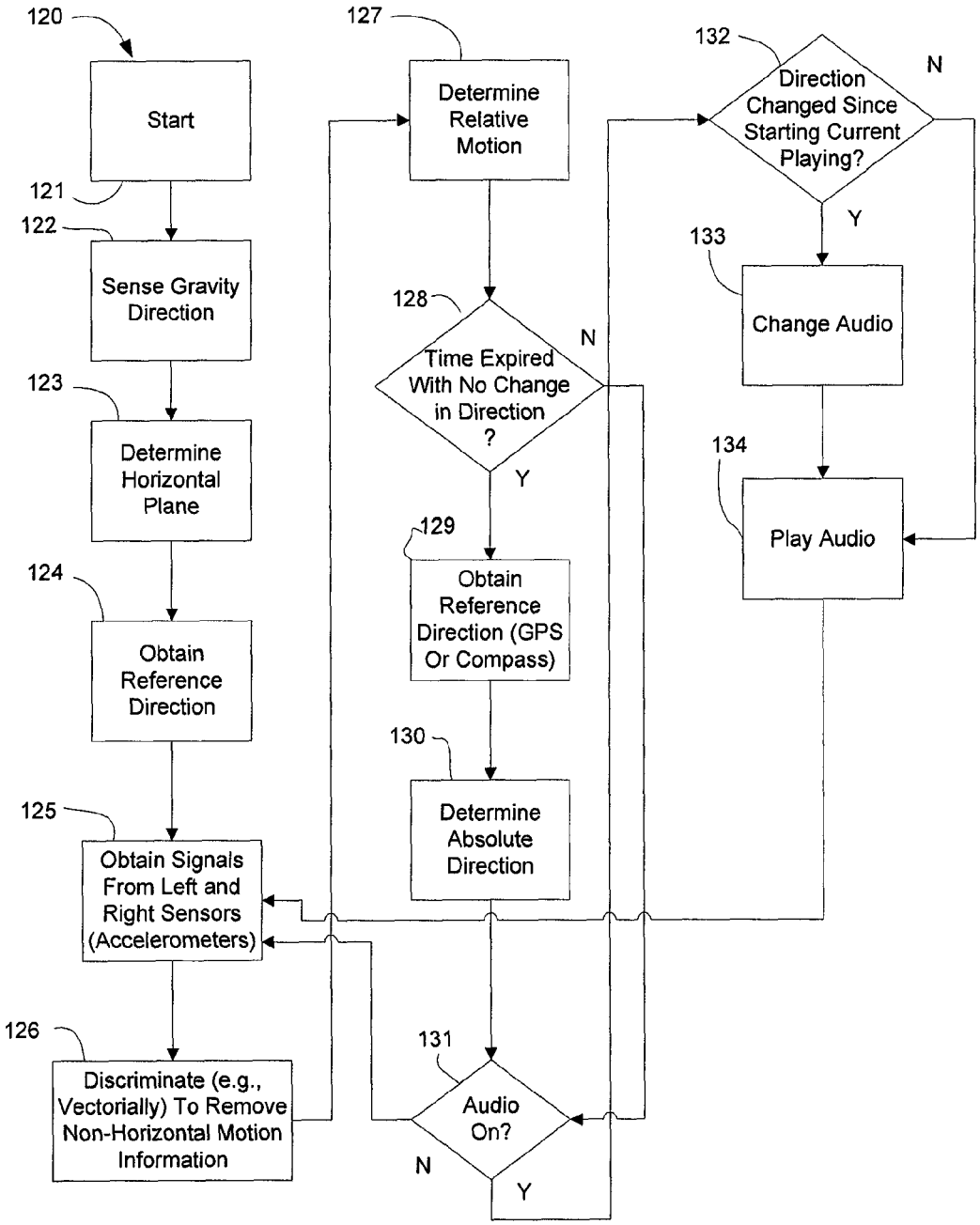
FIG. 11 is a schematic flowchart or logic diagram illustrating an exemplary operation of an audio headset system in connection with playing audio content to a user.

Referring to FIG. 11, a flowchart or logic diagram 120 relating to steps for playing audio content to the user 11 using the audio headset system 10 is illustrated. The logic diagram 120 starts at step 121, e.g., turning on the audio headset system, selecting a function for playing audio content, e.g., music, podcast, lecture, etc. At step 114 gravity direction is sensed, and at step 123 the horizontal plane is determined, e.g., as was described above with respect to FIGS. 7A-7E. At step 124 a reference direction is obtained, e.g., north or a direction relative to a given location such as the ticket counter in a museum and so on. This step may be unnecessary. As an alternative, a starting direction may be obtained that represents, for example, the user facing a forward direction without regard to what is that actual or absolute direction.

At step 125 signals from the left and right sensors, e.g., the accelerometers 14L, 14R, are obtained, and at step 125 the accelerometer signals are discriminated, e.g., vectorially, to remove non-horizontal motion information so that angular motion in the horizontal plane is obtained. At step 127 relative motion is obtained, e.g., angular motion that is representative of rotation of the head 11*h* of the user 11 relative to an absolute direction or a start direction.

At step 128 an inquiry is made whether a prescribed time has expired with no change in direction. If such time has expired, then at step 129 a reference direction, e.g., from a GPS, compass, or other navigation system is obtained. At step 130 the absolute direction is determined indicating the direction that the user is facing. At step 131 an inquiry is made whether the audio system of the audio headset system 10 is turned on, e.g., to play the audio content to the user. If it is not turned on, then the logic diagram moves back to step 125 and the various steps are repeated as described above. However, at step 131 if the audio function is turned on, then at step 132 an inquiry is made as to whether there has been a change in direction since the starting of the current playing of audio content. If there has been a change in direction, then at step 133 the audio content is changed, e.g., the current song being played is changed to another song, the song is repeated or skipped, and so forth. At step 132 the change in direction may be, for example, as was described above, a prescribed type of change, such as a rapid motion of the head followed by a slow motion of the head, or some other combination of motions or simply a single motion.

If at the inquiry 132 there has been no change in direction, then there is no change made to the audio, and the audio content simply is continued to be played at step 134. The logic diagram returns, then, to step 125.

At step 128 if time has not expired with no change in direction, then this would tend to indicate that it is premature to make changes to the audio content or what is being played by the audio headset system 10. The logic diagram then flows to step 131, as was described above. If the audio function is on, then the logic diagram flows to step 132, as was described above. However, if the audio function is not on, then a loop is followed back to step 125.

The foregoing is an example of use and operation of the audio headset system 10 with respect to playing audio content.

Another example of use and operation of the audio headset system 10 is to provide a simulated three dimensional stereophonic music function. For example, if music is playing to the earbuds 12R, 12L in a balanced fashion simulating as though the user 11 is in a concert hall sitting in approximately the center of the hall, the music to both earbuds may be balanced. For example, if the stringed instruments were to the left and the horn instruments were to the right on the orchestra stage, the stringed instruments would be a bit louder in the left earbud 12L and a bit softer in the right earbud 12R; and vice versa with respect to the horn instruments. However, if the user 11 were to turn his head to the right, then the stringed instruments might get a bit softer and the horn instruments a bit louder in the left earbud 12L while the horn instruments remain relatively loud in the right earbud 12R. This operation simulates the sounds as they might be heard if the user 11 were in a concert hall listening to a live concert.

Figure 12:
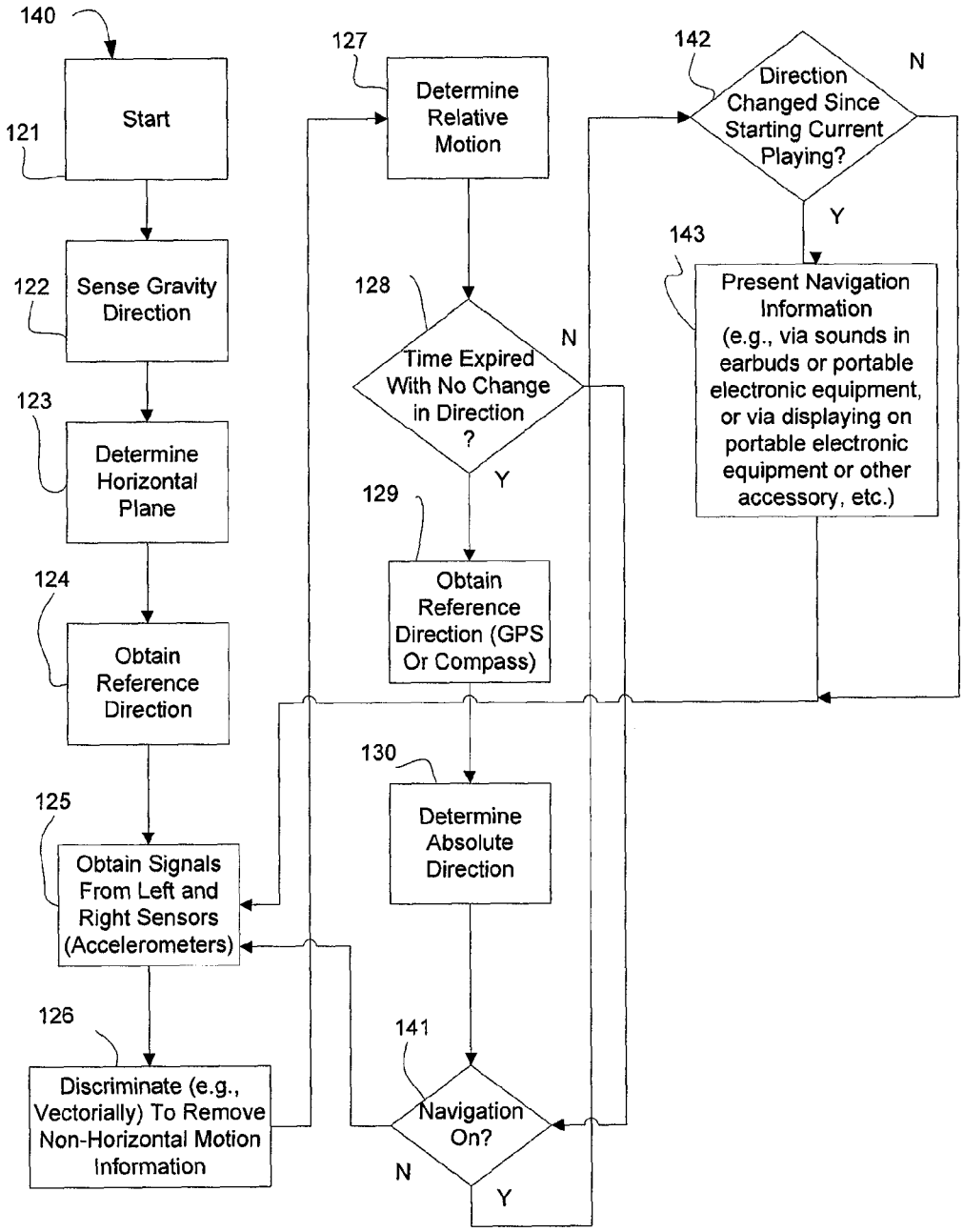
FIG. 12 is a schematic flowchart or logic diagram illustrating an exemplary operation of an audio headset system in connection with providing navigation information to a user.

FIG. 12 is a logic diagram 140 that is similar to the logic diagram 120 of FIG. 11, except instead of functioning to generally play audio content, the audio headset system is set to provide navigation information to the user. For example, steps 121-130 in the logic diagram 140 are the same as those identified by the same reference numeral in the logic diagram 120 of FIG. 11. However, rather than at step 141 inquiring whether audio is on, as was done at step 131 in FIG. 11, in the logic diagram 140 of FIG. 12 the inquiry made at step 141 is whether the navigation function is on or is turned on for the audio headset system 10. If the navigation system is not on, then the logic diagram flows to step 125 in a loop until the navigation system is on. When the navigation system is on at step 141, then at step 142 an inquiry is made of whether there has been a change in direction that the user is facing since the starting of the current playing of navigation information to the user. If there has been no change in direction, then the prior navigation information continues to be played or no navigation information is played until a change is necessary. If there was a change in direction at step 142, then at step 143 navigation information is presented to the user, e.g., via the speakers in the earpieces 12R, 12L. The navigation information also or alternatively may be presented via the portable electronic equipment, e.g., mobile phone 15, or on an accessory, e.g., one associated with the mobile phone, and so on, by displaying it or audibly presenting it. The navigation information at step 143 may be updated navigation information. For example, the user may be walking or facing in a given direction. If there has been no change in that direction, then the navigation system, e.g., a GPS system in the mobile phone 15, may be directing the user to proceed in a given direction. Or to face an object that is in a given direction. However, if the user changes direction, then that change in direction is sensed at step 142 and updated navigation information is provided at step 143. The updated navigation information may not necessarily require input from a GPS, compass or some other absolute direction type of device that identifies a reference direction, such as, for example, north, or the travel direction of the user. Rather, the original information concerning direction of travel, absolute direction, and so forth, may be relied on as known and the change in direction may be a change as compared to the previously obtained reference direction from the GPS, compass, and so on.

Figure 13:
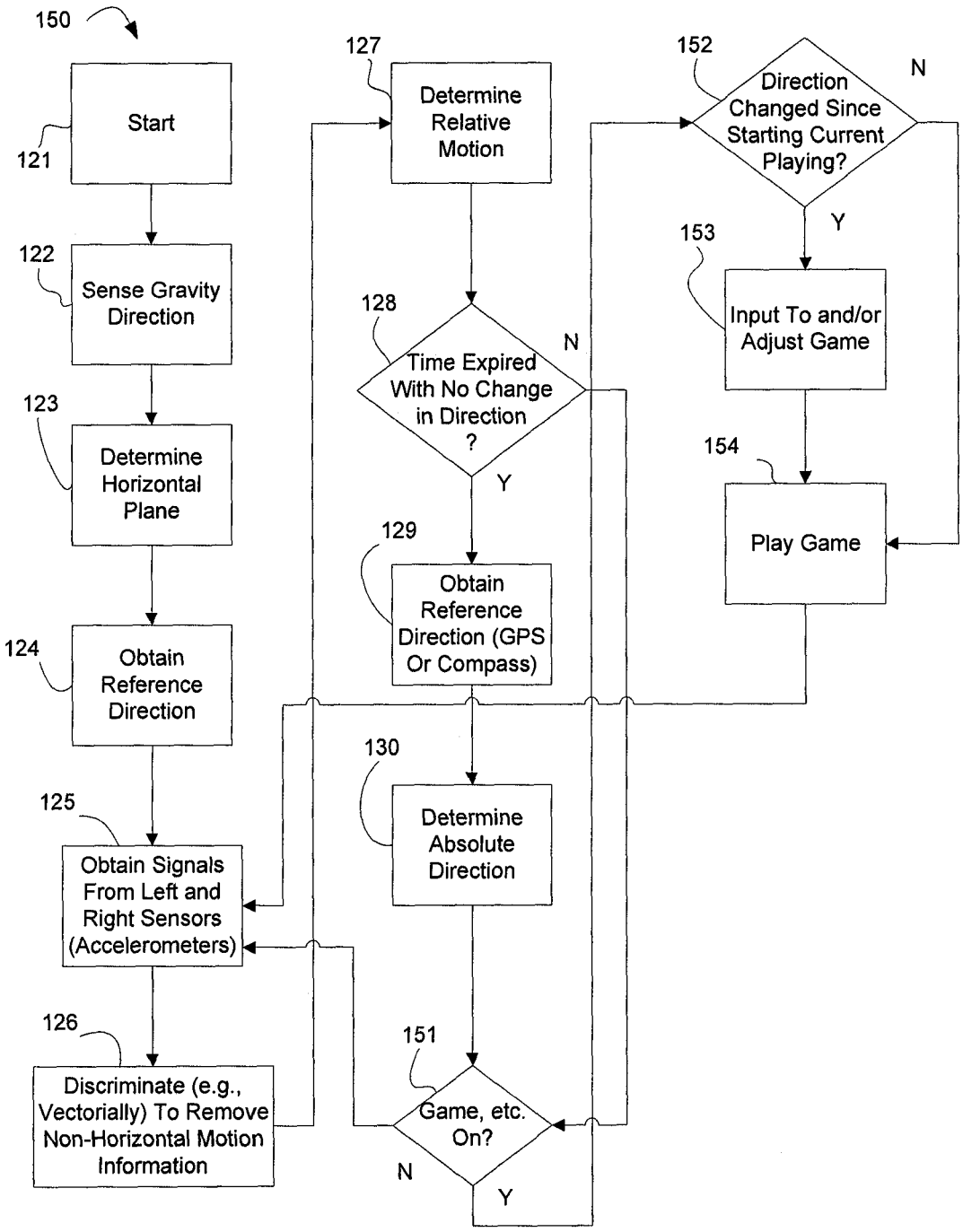
FIG. 13 is a schematic flowchart or logic diagram illustrating an exemplary operation of an audio headset system in connection with providing game and/or other type inputs and playing capabilities.

Briefly referring to FIG. 13, a logic diagram 150 is illustrated. The logic diagram 150 represents an example of using the audio headset system 10 for playing a game. The logic diagram 150 is similar to the logic diagrams 120 and 140 of FIGS. 11 and 12, except that at step 151 an inquiry is made whether a game function has been turned on. If not, then a loop to step 125 is followed. If a game function is turned on, then at step 152 an inquiry is made whether there has been a direction change since starting the current playing of the game. If there has been a change in direction, then that change may be used as an input to the game and/or may adjust the game at step 153. For example, an input to the game may be a rotating of the head 11*h* in a prescribed manner to strike a ball, to make a turn in a road race, and so on. Alternatively, the adjustment to the game at step 153 may be caused by a rotation of the user's head to adjust speed of features in the game, to change the game from one game to another, and so forth. At step 154 the game is played.

From the foregoing, then, it will be appreciated that the audio headset system allows the obtaining information of angular motion in a horizontal plane of the head of the user, and the result of the angular motion information that is obtained can be used for various functions, such as those described herein and/or for other functions.

Figure 14:
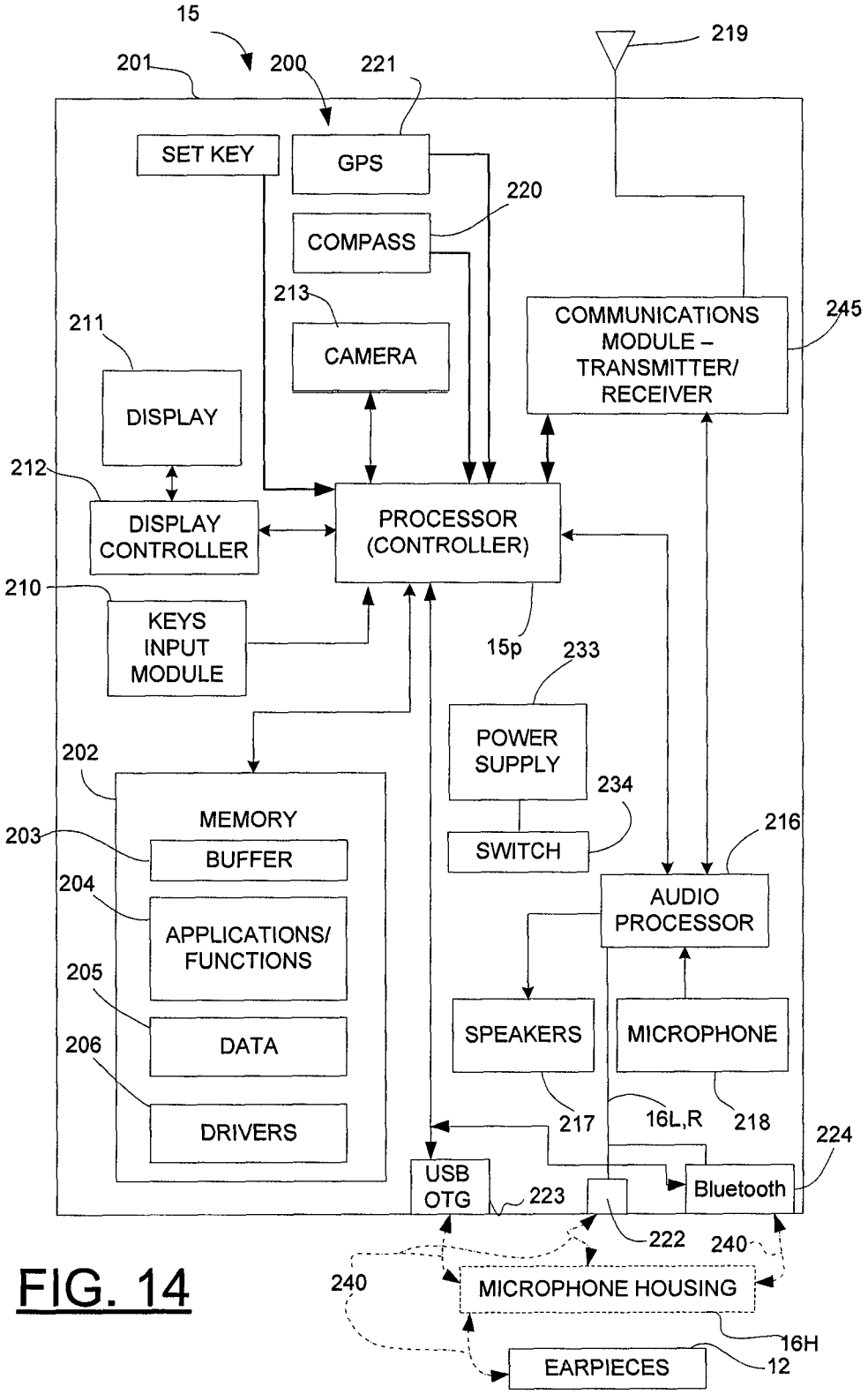
FIG. 14 is a schematic illustration of a portable electronic equipment, such as, for example, a mobile phone.

FIG. 14 illustrates an exemplary mobile phone 15 that may be included as part of the audio headset system 10 of FIGS. 1 and 2, for example. The mobile phone 15 includes operating circuitry 200. The mobile phone 15 may include a housing or case 201, and various parts of the operating circuitry 200 may be within the case and portions of the operating circuitry and/or other parts of the mobile phone 15 may be exposed outside the case to display information and to allow a user to apply inputs to the mobile phone, e.g., by showing information on a display and by pressing respective keys, whether physical keys or keys shown on a touch sensitive display or display screen.

The mobile phone 15 includes a controller or processor 15*p*, which may be a microprocessor ASIC (application-specific integrated circuit), other logic circuitry and/or control circuitry, and so forth. The processor 15*p* may be entirely within the mobile phone 15. Alternatively, part of the processor, e.g., one or more circuits associated with the processor may be included in one or both of the earpieces 12 (FIGS. 1 and 2). As another alternative, the processor may be included entirely in one or both of the earpieces 12, as is illustrated at 28 in FIG. 4.

The mobile phone 15 includes a memory 202. The memory may include a buffer memory portion 203, an applications/functions portion 204, a data portion 205, and a drivers portion 206. The portions of the memory 202 may be portions of the overall memory or may be separate circuits. The buffer may temporarily store data, applications, and so forth, as is typical for a buffer memory. The applications/functions portion 204 may store respective operating instructions, computer programs, logic, and so forth to control operation of the mobile phone 15 and the respective earpieces 12 of the audio headset system 10. Various data may be stored in the data portion 205, and drivers for various parts of the mobile phone, for the earpieces 12, and so forth, may be stored in the drivers portion 206 of the memory 202.

The mobile phone 15 includes a keys input module 210, for example, a number of pushbutton keys, keys shown on a touch screen display device, or the like. The keys may be operated by a user 11 to operate the mobile phone, e.g., to carry out the various functions described above and also to carry out various telecommunication functions typically carried out in a mobile phone.

The mobile phone 15 also includes a display 211 and display controller 212 that controls information shown on the display and also may receive inputs from touches by a user against the display. The mobile phone may include a camera 213 and a telecommunications portion 214. The telecommunications portion includes a communications module-transmitter/receiver 215, an audio processor 216, one or more speakers 217, and a microphone 218. The telecommunications portion 214 also includes an antenna 219 to transmit radio signals and to receive radio signals to carry out the various telephone communications, message communications, Internet browsing, and/or other functions of the mobile phone with respect to remote devices with which the mobile phone may be connected by radio. Operation of the various portions of the mobile phone, as are mentioned above, may be carried out under control of the processor 15*p* in response to inputs provided by a user, inputs received remotely, e.g., via the telecommunications portion 214, and by computer program code, logic, and so forth that relate to respective applications and functions of the mobile phone as stored, for example, in the memory 202.

As is illustrated in FIG. 14, the mobile phone 15 also includes a compass 220 and a GPS 221. The compass and GPS provide usual functions. The compass 220 may provide electrical signals to the processor 15*p* indicating direction information sensed by the compass. The GPS 221 may receive signals from a global position satellite system and provide those signals to the processor 15*p* to indicate direction, motion, and so forth, as is typical for a GPS system and a device receiving signals representing the output from the GPS.

Connections between the mobile phone 15 and the earpieces 12L, 12R may be made via any of a number of devices, such as, wired, wireless or WiFi. For example, the mobile phone 15 may include an audio jack device 222, a USB connector device 223 and/or a wireless connection device 224 such as, for example, a Bluetooth device, WiFi device, and so on. There are various possibilities for using those devices for communicating signals between the mobile phone and the earpieces 12L, 12R, several examples of which are illustrated schematically in FIG. 14 by respective phantom lines with double-headed arrows designated by reference numeral 240.

As one example, a connection may be provided between the audio jack 222 and the microphone housing 16H and/or circuitry thereof; and from the microphone housing to the earpieces 12L, 12R. The microphone housing 16H is shown in dash lines as an indication that it may not be needed, and in such case the connection may be provided directly between the audio jack 222 and the earpieces 12L, 12R.

As another example, a connection may be made between a USB port (also referred to as a USB connector device) 223 to the microphone housing 16H and/or circuitry thereof, and from the microphone housing to the earpieces 12L, 12R. The USB port 223 may be a USB OTG (USB on the go) type device. As was mentioned above, in some circumstances it may be that a direct connection is made between the USB port 223 and the earpieces 12L, 12R, e.g., in the event that a microphone housing 16H and microphone 16M (see FIGS. 3 and 4) would be unnecessary.

As a further example, a wireless connection device 224, e.g., a Bluetooth connection device, may be used to provide for coupling of signals directly between the mobile phone 15 and the earpieces 12L, 12R. Alternatively or additionally, a Bluetooth connection may be provided between the microphone housing 16H and circuitry thereof and the earpieces 12L, 12R.

As even a further example, a wired connection may be provided between the mobile phone 15 and the microphone housing 16H and circuitry therein; and a Bluetooth connection may be provided between the microphone housing and the earpieces 12L, 12R.

In the several examples mentioned above, it will be appreciated that appropriate circuitry may be provided in the respective components mentioned as needed to carry out the signal coupling tasks, e.g., Bluetooth transmitters and receivers, amplifiers, switching circuitry, signal flow control circuitry, and so on.

The mentioned connections or coupling of signals may provide for coupling of signals to and/or from the audio processor 216 and/or to and/or from the processor (controller) 15*p*. As a non-limiting example, a connection is shown from the audio processor 216 to the audio jack 222 and/or to the Bluetooth connection device 224; and a connection is shown between the processor (controller) 15*p* and the USB port 223 and/or to the Bluetooth connection device 224. Various other connections may be provided and devices used to couple signals between the mobile phone (or other electronic device) 15 and the earpieces 12L, 12R.

The speakers 217 may be within the housing 201 of the mobile phone 15, and, as is described above, the connections 16L, 16R to the earpieces 12L, 12R may be provided via the audio jack 222, USB port 223, Bluetooth device 224 or some other device directly to the speakers 20 of the earpieces 12L, 12R or via the microphone housing 16H and associated circuitry. Thus, sounds may be provided via the speakers 217 and/or via the earpieces 12L, 12R.

Signals may be coupled in one direction or in both directions between the mobile phone (electronic device) 15 and the earpieces 12L, 12R. Coupling signals, whether by wired coupling or transmission or by a wireless coupling or transmission or by both wired and wireless or a combination thereof allows signals to be sent to the earpieces 12 to provide audio output to a user and signals to be received from the earpieces, e.g., from the accelerometers, for processing and/or other use in the portable electronic equipment 15, e.g., mobile phone. The connections 16L, 16R also may couple acceleration signals from the accelerometers 14L, 14R to the mobile phone, e.g., to the processor 15*p* (see connections 16L', 16R') and/or to other circuitry associated with the processor, which may carry out the steps described above (or other appropriate steps) to obtain the angular motion information of the user's head in a horizontal plane.

Computer code, logic, and so on may be included in the memory 202 and cooperative with the processor 15*p* and/or with other portions of the mobile phone 15 and the earpieces 12L, 12R to configure the processor and the various other portions of the mobile phone 15 and earpieces to carry out the various functions and operations described herein.

A power supply 323 and a power on/off switch 234 are provided to supply electrical power to the various portions of the operating circuitry 200 and also, if necessary, to the earpieces 12L, 12R for operation as described above.

From the foregoing it will be appreciated that the audio headset system 10 determines or measures angular motion of the head 11*h* of the user 11 in a generally horizontal plane. The information pertaining to such angular motion may be used for various purposes, e.g., those described herein and other purposes, as may be desired.

Conveniently the earpieces do not require mechanical connection. Therefore, they may be relatively small, relatively low-power devices, relatively inexpensive, for example, as compared to typical headphone systems in which the various speaker components are mechanically connected in relation to each other by a bar, strap or the like.

A user should be confident that the ear pieces 12 are appropriately in position in his ears 13. Various detectors are available to detect that an ear piece, such as an earbud, is properly in position in a user's ear. Capacitive sensors and infrared proximity sensors have been used in the past for this purpose. In an embodiment of the invention the output from such an "in position" sensor may be used to determine whether other portions of an ear piece are turned on, operative and so on. For example, if an earpiece is not sensed as being in proper position, the speaker thereof and/or the direction sensor system may be turned off or turned to a reduced power level to avoid wasting power. Upon sensing proper positioning in an ear, the proximity sensor may provide an output that turns on or turns up operating power for the earpiece.

Operation of the mobile phone 15 in cooperation with the audio headset system 10 may be under computer program control or the like. Such operation may be as is performed to carry out the functions of a mobile phone and the various steps, operations and procedures described above may be carried out under computer program control or the like.

It will be appreciated that portions of the present invention can be implemented in hardware, software, firmware, or a combination thereof. In the described embodiment(s), a number of the steps or methods may be implemented in software or firmware that is stored in a memory and that is executed by a suitable instruction execution system. If implemented in hardware, for example, as in an alternative embodiment, implementation may be with any or a combination of the following technologies, which are all well known in the art: discrete logic circuit(s) having logic gates for implementing logic functions upon data signals, application specific integrated circuit(s) (ASIC) having appropriate combinational logic gates, programmable gate array(s) (PGA), field programmable gate array(s) (FPGA), etc.

Any process or method descriptions or blocks in flow charts may be understood as representing modules, segments, or portions of code which include one or more executable instructions for implementing specific logical functions or steps in the process, and alternate implementations are included within the scope of the preferred embodiment of the present invention in which functions may be executed out of order from that shown or discussed, including substantially concurrently or in reverse order, depending on the functionality involved, as would be understood by those reasonably skilled in the art of the present invention.

The logic and/or steps represented in the flow diagrams of the drawings, which, for example, may be considered an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The above description and accompanying drawings depict the various features of the invention. It will be appreciated that the appropriate computer code could be prepared by a person who has ordinary skill in the art to carry out the various steps and procedures described above and illustrated in the drawings. It also will be appreciated that the various terminals, computers, servers, networks and the like described above may be virtually any type and that the computer code may be prepared to carry out the invention using such apparatus in accordance with the disclosure hereof.

Specific embodiments of an invention are disclosed herein. One of ordinary skill in the art will readily recognize that the invention may have other applications in other environments. In fact, many embodiments and implementations are possible. The following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

We claim:

1. An audio headset system, comprising a pair of earpieces free of mechanical supporting connection between each other, each earpiece including a speaker configured to provide audio output, and a housing, the speaker mounted with respect to the housing, the housing configured for positioning with respect to an ear of a user to direct audio output from the speaker to the ear; and a pair of accelerometers configured to provide acceleration information representative of acceleration of the respective earpieces, wherein each of the accelerometers is mounted in or on a respective earpiece; and a processor configured to:

process the acceleration information from the pair of accelerometers by normalizing the acceleration information from a first accelerometer of the pair of accelerometers with a second accelerometer of the pair of accelerometers, thereby obtaining acceleration information of the audio headset system in one plane, and calculate a direction of rotation of the pair of earpieces in the one plane based on the acceleration information of the audio headset in the one plane, and the amount of the rotation, wherein the direction and amount of rotation is representative of angular motion of the head of the user.

2. The system claim 1, wherein the earpieces are configured for at least partial insertion in respective ears.

3. The system claim 1, wherein the one plane is a generally horizontal plane.

4. The system of claim 3, wherein the processor is configured to process acceleration information to determine amount and/or direction of angular motion relative to a reference direction, and wherein the accelerometers provide acceleration information indicative of the reference direction.

5. The system of claim 3, further comprising an input that is selectively operable by a user to set a reference facing direction, and wherein the processor is configured to determine from reference direction information and acceleration output information substantially the absolute facing direction of a user wearing the earpieces.

6. The system of claim 3, further comprising a direction sensing device configured to receive signal information representing a reference direction from a compass or from a satellite based device (e.g., global positioning system (GPS), Galileo navigation system or Glonass navigation system, etc.).

7. The system of claim 3, wherein the processor is configured to distinguish between angular motion in a generally horizontal plane and motion that is not in a generally horizontal plane.

8. The system of claim 3, further comprising an input to the processor representing the direction of gravity, and wherein the processor is configured to determine a generally horizontal plane relative to the direction of gravity.

9. The system of claim 3, wherein the accelerometers are three axis accelerometers configured to provide acceleration information representing acceleration vectors in three orthogonal directions, and wherein the processor is configured to project mathematically the respective acceleration vectors from each accelerometer in a representation of a generally horizontal plane, whereby the projections of the vectors are combinable to indicate magnitude and direction of acceleration of the respective earpieces in the generally horizontal plane to determine angular motion in the generally horizontal plane of the head of a user wearing both earpieces of the audio headset system without regard to orientation of the respective earpieces with respect to the ears of a user.

10. The system of claim 3, wherein the processor is configured to determine the difference between acceleration information from the two accelerometers that is substantially the same magnitude but of different sign representing rotation of a user's head generally in a horizontal plane compared to acceleration output information from the two accelerometers that is substantially different or is substantially the same but of the same sign and represents motion of a user's head other than a rotation in a generally horizontal plane.

11. The system of claim 3, further comprising portable electronic equipment connectable to the earpieces to provide signals to the earpieces to provide output sounds to the ears.

12. The system of claim 11, wherein the portable electronic equipment comprises a mobile telephone.

13. The system of claim 11, wherein the portable electronic equipment is at least one of a music player, video player, navigation device, digital still camera, digital video camera or combination digital still and video camera.

14. The system of claim 11, wherein the processor is in at least one of one earpiece, both earpieces or the portable electronic equipment.

15. The system of claim 3, further comprising an audio content source and/or a source of navigation information and wherein the speakers of the earpieces are configured to respond to signals to provide audio output representing the audio content or navigation information to a user wearing the earpieces, and wherein the processor is configured to change audio content and/or navigation information based on the facing direction of the user's head wearing the earpieces.

16. The system of claim 3, wherein the processor is configured to change volume of sounds provided as outputs from respective earpieces based on facing direction of a user wearing the earpieces.

17. A method of determining rotation and/or direction of a user's head wearing a headset including an earpiece at each ear and each earpiece having an accelerometer and being free of mechanical supporting connection between each other, comprising processing acceleration information from both accelerometers to determine angular motion of the user's head in a generally horizontal plane wherein said processing comprises normalizing the acceleration information from a first accelerometer of a first earpiece with a second accelerometer of a second earpiece, thereby obtaining acceleration information of the headset in one plane.

18. The method of claim 17, said processing further comprising considering the accelerometers as generally symmetrically located relative to the axis of rotation of the head, and wherein said processing comprises using the relative movement of the earpieces in relation to each other as an indication of angular motion or direction of angular motion.

19. The method of claim 18, wherein the accelerometers are three-axis accelerometers, and said processing comprises normalizing the acceleration vector signals for each axis from each of the accelerometers to obtain respective horizontal acceleration vector components in a generally horizontal plane, and combining respective horizontal acceleration vector components from each accelerometer to obtain direction and magnitude of acceleration in the generally horizontal plane, and further comprising determining the direction of gravity to identify the generally horizontal plane.

* * * * *